US009027517B2

(12) United States Patent
Hayashida et al.

(10) Patent No.: US 9,027,517 B2
(45) Date of Patent: May 12, 2015

(54) VARIABLE VALVE TIMING APPARATUS FOR INTERNAL COMBUSTION ENGINE

(75) Inventors: Atsushi Hayashida, Toyota (JP); Yoshihito Moriya, Nagoya (JP); Haruhito Fujimura, Toyota (JP); Yoshirou Kamo, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 429 days.

(21) Appl. No.: 13/695,523

(22) PCT Filed: Apr. 14, 2011

(86) PCT No.: PCT/IB2011/000828

§ 371 (c)(1),
(2), (4) Date: Oct. 31, 2012

(87) PCT Pub. No.: WO2011/135419

PCT Pub. Date: Nov. 3, 2011

(65) Prior Publication Data

US 2013/0042829 A1 Feb. 21, 2013

(30) Foreign Application Priority Data

Apr. 28, 2010 (JP) ..... 2010-103679

(51) Int. Cl.
*F01L 9/02* (2006.01)
*F01L 1/344* (2006.01)

(52) U.S. Cl.
CPC ..... *F01L 1/3442* (2013.01)

(58) Field of Classification Search
CPC ..... F01L 9/02; F01L 9/023; F01L 1/3442
USPC ..... 123/90.12, 90.15, 90.17
See application file for complete search history.

(56) References Cited

U.S. PATENT DOCUMENTS 7,252,054 B2 * 8/2007 Weber et al. ..... 123/90.15
2002/0166522 A1 11/2002 Takahashi et al.

(Continued)

FOREIGN PATENT DOCUMENTS

DE 100 55 770 5/2002
DE 102 28 832 1/2003

(Continued)

OTHER PUBLICATIONS

Japanese Office Action Issued Feb. 23, 2012 in JP Application No. 2010-103679 Filed Apr. 28, 2010 (with partial English translation).

(Continued)

*Primary Examiner* — John Kwon
(74) *Attorney, Agent, or Firm* — Oblon, McClelland, Maier & Neustadt, L.L.P.

(57) ABSTRACT

A variable valve timing apparatus includes: a variable valve timing mechanism that changes a valve timing and locks the valve timing at a most retarded timing; an oil control valve that controls a mode in which hydraulic fluid is supplied to the variable valve timing mechanism; and a controller that varies a duty ratio of the oil control valve within a set range that includes an advance active band, a retard active band, a holding range, an advance release range and a retard release range. In the advance release range, a varying speed of the valve timing is higher than the holding range and a housing rotor is disengaged from a vane rotor. When an engine operating state is a release request state, the controller sets the duty ratio of the oil control valve within the advance release range.

13 Claims, 11 Drawing Sheets

(56) References Cited

U.S. PATENT DOCUMENTS

| | | | | |
|---|---|---|---|---|
| 2003/0010303 | A1 | 1/2003 | Kanada et al. | |
| 2003/0200944 | A1 | 10/2003 | Takahashi et al. | |
| 2003/0221663 | A1* | 12/2003 | Vanderpoel et al. | 123/321 |
| 2003/0230262 | A1 | 12/2003 | Quinn, Jr. | |
| 2005/0098130 | A1 | 5/2005 | Hirowatari et al. | |
| 2005/0252484 | A1* | 11/2005 | Vanderpoel et al. | 123/321 |
| 2006/0100802 | A1* | 5/2006 | Miyakoshi et al. | 702/79 |
| 2007/0125327 | A1* | 6/2007 | Yang et al. | 123/90.12 |
| 2008/0006231 | A1* | 1/2008 | Noss et al. | 123/90.12 |
| 2010/0006045 | A1 | 1/2010 | Nakano et al. | |
| 2011/0023804 | A1* | 2/2011 | Takemura | 123/90.17 |
| 2013/0042829 | A1* | 2/2013 | Hayashida et al. | 123/90.15 |
| 2013/0213326 | A1* | 8/2013 | Fujimura et al. | 123/90.12 |

FOREIGN PATENT DOCUMENTS

| | | |
|---|---|---|
| EP | 1 375 836 | 1/2004 |
| EP | 1 531 248 | 5/2005 |
| JP | 2003 314313 | 11/2003 |
| JP | 2004 346846 | 12/2004 |
| JP | 2005 146922 | 6/2005 |
| JP | 2008 175165 | 7/2008 |
| JP | 2009 92077 | 4/2009 |
| JP | 2009 203830 | 9/2009 |
| JP | 2009 299585 | 12/2009 |

OTHER PUBLICATIONS

International Search Report Issued Sep. 2, 2011 in PCT/IB11/000828 Filed Apr. 14, 2011.

* cited by examiner

VALVE TIMING CONTROL AT MOST RETARDED TIMING

VARIABLE VALVE TIMING APPARATUS FOR INTERNAL COMBUSTION ENGINE

BACKGROUND OF THE INVENTION

1. Field of the Invention

The invention relates to a variable valve timing apparatus for an internal combustion engine, which includes a hydraulic variable valve timing mechanism that varies the relative rotational phase of an output rotor with respect to an input rotor to change the valve timing.

2. Description of the Related Art

Conventional variable valve-timing apparatuses generally include, for example, a hydraulic variable valve timing mechanism, a hydraulic control mechanism and a controller, as described in Japanese Patent Application Publication No. 2009-203830 (JP-A-2009-203830). Hydraulic variable valve-timing mechanisms adjust the valve timing by varying the rotational phase of an output rotor with respect to an input rotor and lock the valve timing to the most retarded timing by engaging the input rotor with the output rotor.

The controller sets the duty ratio of the hydraulic control mechanism at 100% when there is a request to unlock the valve timing. Accordingly, the operation mode of the hydraulic control mechanism is changed to a state where the valve timing is advanced and is unlocked.

Thus, oil is supplied to advance chambers of the hydraulic variable valve timing mechanism, and drained from retard chambers. In addition, oil is supplied to a release chamber to withdraw a lock pin from an engaging hole. Accordingly, the engagement of the input rotor and the output rotor by the lock pin is released.

However, if the duty ratio is set at 100% when the valve timing is unlocked, the lock pin may become pressed against the engaging hole before the lock pin withdraws from the engaging hole to interfere with a withdrawal of the lock pin from the engaging hole.

Document EP 1 531 248 A1 discloses a variable valve timing apparatus for an engine, which has a hydraulic variable valve timing mechanism to change a valve timing by varying a rotational phase of an output rotor with respect to an input rotor and locks the valve timing to a specified timing by engaging input rotor with output rotor; a hydraulic control mechanism to control supply of hydraulic fluid to the hydraulic variable valve timing mechanism; and a controller to vary a duty ratio of the hydraulic control mechanism.

Document DE 100 55 770 A1 discloses a method for operating a valve for a hydraulic device. In the method, during unlocking, pressure is increased slowly with a lower oil pressure, and after the unlocking operation, an oil pressure control switches to a normal oil pressure control.

Document US 2003/0200944 A1 discloses a variable valve timing apparatus for an engine, which has a cam phase actuator, an oil pump, arithmetic means and a hydraulic pressure regulator. The arithmetic means determines a locked and unlocked state of a lock mechanism. An unlocking operation is performed at low rate.

Document US 2002/0166522 A1 discloses a variable valve timing apparatus for an engine, which has sensor means, cam shafts for intake or exhaust valves, an actuator driving the valves, a hydraulic pressure supply unit for the actuator, and a control means. The control means executes an unlocking operation of a locking mechanism.

SUMMARY OF INVENTION

The invention provides a variable valve timing apparatus for an internal combustion engine, which is able to smoothly unlock the valve timing.

The invention provides a variable valve timing apparatus for an internal combustion engine. The variable valve timing apparatus includes: a hydraulic variable valve timing mechanism that has the function of changing a valve timing by varying a rotational phase of an output rotor with respect to an input rotor and the function of locking the valve timing at a specific timing by engaging the input rotor and the output rotor with each other; a hydraulic control mechanism that controls a mode in which hydraulic fluid (i.e. lubricating oil) is supplied to the hydraulic variable valve timing mechanism; and a controller that varies a duty ratio of the hydraulic control mechanism within a set range. The set range includes a dead band and an active band. The dead band includes a holding range and a release range. The holding range includes a holding duty ratio at which a varying speed of the valve timing is zero. The release range is a range in which a varying speed of the valve timing is higher than that in the holding range and engagement of the input rotor and the output rotor is released. The active band is a range in which a varying speed of the valve timing is higher than that in the holding range and release range of the dead band. When an engine operating state is a release request state, the controller sets the duty ratio of the hydraulic control mechanism to a duty ratio that falls within the release range.

With the above variable valve timing apparatus, when the engine operating state is the release request state, the duty ratio of the hydraulic control mechanism is set to a duty ratio that falls within the release range. That is, when engagement of the input rotor and the output rotor is released, the duty ratio of the hydraulic control mechanism is set so as to be closer to the holding range than the duty ratio of the active band. Thus, it is possible to smoothly unlock the valve timing.

In addition, in the variable valve timing apparatus, the release range may be an advance release range in which an advance speed that is a varying speed at which the valve timing is advanced is higher than the holding range and engagement of the input rotor and the output rotor is released, and, when the engine operating state is the release request state, the controller may set the duty ratio of the hydraulic control mechanism to a duty ratio that falls within the advance release range.

With the above variable valve timing apparatus, when the engine operating state is the release request state, the duty ratio of the hydraulic control mechanism is set to a duty ratio that falls within the advance release range, so it is possible to reduce the frequency of a situation that engagement of the input rotor and the output rotor is not released because of a high advance speed of the valve timing.

In addition, in the variable valve timing apparatus, a duty ratio at which the advance speed of the valve timing is a first advance speed may be set as a first advance duty ratio, a duty ratio at which the advance speed of the valve timing is a second advance speed that is higher than the first advance speed may be set as a second advance duty ratio, and a range from the first advance duty ratio to the second advance duty ratio may be set as the advance release range.

With the above variable valve timing apparatus, when the duty ratio of the hydraulic control mechanism is set so as to fall within the advance release range, the advance speed of the valve timing is lower than the second advance speed. In addition, when the duty ratio of the hydraulic control mechanism is set so as to fall within the active band, the advance speed of the valve timing is higher than the second advance speed.

In addition, in the variable valve timing apparatus, the release request state is an operating state where the valve timing is the specific timing and the engine operating state is an advance request state, and, when the engine operating state is the release request state, the controller sets the duty ratio of the hydraulic control mechanism to a duty ratio that falls within the advance release range, and, when it is detected or estimated that the valve timing has been changed to be more advanced than the specific timing thereafter, the controller adjusts the duty ratio of the hydraulic control mechanism to a duty ratio that falls within the active band.

With the above variable valve timing apparatus, when it is detected or estimated that the valve timing has been changed to be more advanced than the specific timing, that is, when it is detected or estimated that engagement of the input rotor and the output rotor is released, the duty ratio is varied from a value that falls within the dead band to a value that falls within the active band based on the advance request. Thus, it is possible to prevent the advance speed of the valve timing from being increased before engagement of the input rotor and the output rotor is released.

In addition, in the variable valve timing apparatus, the hydraulic variable valve timing-mechanism may include an advance chamber used to advance the valve timing, a retard chamber used to retard the valve timing and an advance release chamber used to unlock the valve timing from the specific timing, the hydraulic control mechanism may have a plurality of operation modes having different modes in which hydraulic fluid is supplied to the hydraulic variable valve timing mechanism and may have an advance release mode, as one of the plurality of operation modes, in which hydraulic fluid is supplied to the advance chamber and the advance release chamber and hydraulic fluid in the retard chamber is held, and, when the engine operating state is the release request state, the controller may set the duty ratio of the hydraulic control mechanism to a duty ratio that falls within the advance release range to thereby set the operation mode of the hydraulic control mechanism to the advance release mode.

In the above variable valve timing apparatus, when the engine operating state is the release request state, hydraulic fluid is supplied to the advance chamber and the advance release chamber and hydraulic fluid is retained in the retard chamber, thereby reducing the speed at which the valve timing is advanced relative that when hydraulic fluid is not retained in the retard chamber. Thus, it is possible to further smoothly unlock the valve timing.

In addition, in the variable valve timing apparatus, hydraulic fluid may be supplied to the advance chamber when the rotational phase of the output rotor is advanced with respect to the input rotor, and hydraulic fluid may be drained from the advance chamber when the rotational phase of the output rotor is retarded with respect to the input rotor, hydraulic fluid may be supplied to the retard chamber when the rotational phase of the output rotor is retarded with respect to the input rotor, lubricating hydraulic fluid may be drained from the retard chamber when the rotational phase of the output rotor with respect to the input rotor is advanced, and hydraulic fluid (i.e. lubricating oil) in the retard chamber may be held when the hydraulic control mechanism is set in the advance release mode, and the advance release chamber may be supplied with hydraulic fluid via the advance chamber.

Accordingly, when the operation mode of the hydraulic control mechanism is set to the advance release mode, hydraulic fluid is supplied to the advance chamber, hydraulic fluid is supplied to the advance release chamber via the advance chamber, and hydraulic fluid in the retard chamber is held. By so doing, engagement of the input rotor and the output rotor is smoothly released.

In addition, in the variable valve timing apparatus, the hydraulic variable valve timing mechanism may have the function of changing the valve timing of an intake valve by varying the rotational phase of the output rotor with respect to the input rotor and the function of holding the valve timing at a most retarded timing as the specific timing by engaging the input rotor and the output rotor with each other.

In addition, in the variable valve timing apparatus, the release range may be a retard release range in which a retard speed that is a varying speed at which the valve timing is retarded is higher than the holding range and engagement of the input rotor and the output rotor is released, and, when the engine operating state is the release request state, the controller may set the duty ratio of the hydraulic control mechanism to a duty ratio that falls within the retard release range.

With the above variable valve timing apparatus, when the engine operating state is the release request state, the duty ratio of the hydraulic control mechanism is set to a duty ratio that falls within the retard release range, so it is possible to reduce the frequency of a situation that engagement of the input rotor and the output rotor is not released because of a high retard speed of the valve timing.

In addition, in the variable valve timing apparatus, a duty ratio at which the retard speed of the valve timing is a first retard speed may be set as a first retard duty ratio, a duty ratio at which the retard speed of the valve timing is a second retard speed that is higher than the first retard speed may be set as a second retard duty ratio, and a range from the second retard duty ratio to the first retard duty ratio may be set as the retard release range.

With the above variable valve timing apparatus, when the duty ratio of the hydraulic control mechanism is set so as to fall within the retard release range, the retard speed of the valve timing is lower than the second retard speed. In addition, when the duty ratio of the hydraulic control mechanism is set so as to fall within the active band, the retard speed of the valve timing is higher than the second retard speed.

In addition, in the variable valve timing apparatus, the release request state is an operating state where the valve timing is the specific timing and the engine operating state is a retard request state, and, when the engine operating state is the release request state, the controller sets the duty ratio of the hydraulic control mechanism to a duty ratio that falls within the retard release range, and, when it is detected or estimated that the valve timing has been changed to be more retarded than the specific timing thereafter, the controller adjusts the duty ratio of the hydraulic control mechanism to a duty ratio that falls within the active band.

With the above variable valve timing apparatus, when it is detected or estimated that the valve timing has been changed to be more retarded than the specific timing, that is, when it is detected or estimated that engagement of the input rotor and the output rotor is released, the duty ratio is varied from a value that falls within the dead band to a value that falls within the active band based on the retard request. Thus, it is possible to prevent the retard speed of the valve timing from being increased before engagement of the input rotor and the output rotor is released.

In addition, in the variable valve timing apparatus, the hydraulic variable valve timing mechanism may include an advance chamber used to advance the valve timing, a retard chamber used to retard the valve timing and a retard release chamber used to unlock the valve timing from the specific timing, the hydraulic control mechanism may have a plurality of operation modes having different modes in which hydraulic fluid is supplied to the hydraulic variable valve timing mechanism and may have a retard release mode, as one of the plurality of operation modes, in which hydraulic fluid is supplied to the retard chamber and the retard release chamber and hydraulic fluid in the advance chamber is held, and, when the engine operating state is the release request state, the controller may set the duty ratio of the hydraulic control mechanism to a duty ratio that falls within the retard release range to thereby set the operation mode of the hydraulic control mechanism to the retard release mode.

With the above variable valve timing apparatus, when the engine operating state is the release request state, hydraulic fluid is supplied to the retard chamber and the retard release chamber and hydraulic fluid in the advance chamber is held, so the retard speed of the valve timing is lower than that when hydraulic fluid in the advance chamber is not held. Thus, it is possible to further smoothly unlock the valve timing.

In addition, in the variable valve timing apparatus, hydraulic fluid may be supplied to the advance chamber when the rotational phase of the output rotor with respect to the input rotor is advanced, hydraulic fluid may be drained from the advance chamber when the rotational phase of the output rotor with respect to the input rotor is retarded, and hydraulic fluid in the advance chamber may be held when the hydraulic control mechanism is set in the retard release mode, hydraulic fluid may be supplied to the retard chamber when the rotational phase of the output rotor with respect to the input rotor is retarded, and hydraulic fluid may be drained from the retard chamber when the rotational phase of the output rotor with respect to the input rotor is advanced, and the retard release chamber may be supplied with hydraulic fluid via the retard chamber.

With the above variable valve timing apparatus, when the operation mode of the hydraulic control mechanism is set to the retard release mode, hydraulic fluid is supplied to the retard chamber, hydraulic fluid is supplied to the retard release chamber via the retard chamber, and hydraulic fluid in the advance chamber is held. By so doing, engagement of the input rotor and the output rotor is smoothly released.

In addition, in the variable valve timing apparatus, the hydraulic variable valve timing mechanism may have the function of changing the valve timing of an exhaust valve by varying the rotational phase of the output rotor with respect to the input rotor and the function of holding the valve timing at a most advanced timing as the specific timing by engaging the input rotor and the output rotor with each other.

In addition, in the variable valve timing apparatus, the controller may learn the holding duty ratio after a start of the engine, and, when the engine operating state is the release request state, the controller may set the release range based on the learned holding duty ratio.

BRIEF DESCRIPTION OF DRAWINGS

The features, advantages, and technical and industrial significance of this invention will be described below with reference to the accompanying drawings, in which like numerals denote like elements, and wherein.

DETAILED DESCRIPTION OF EMBODIMENTS

Figure 1:
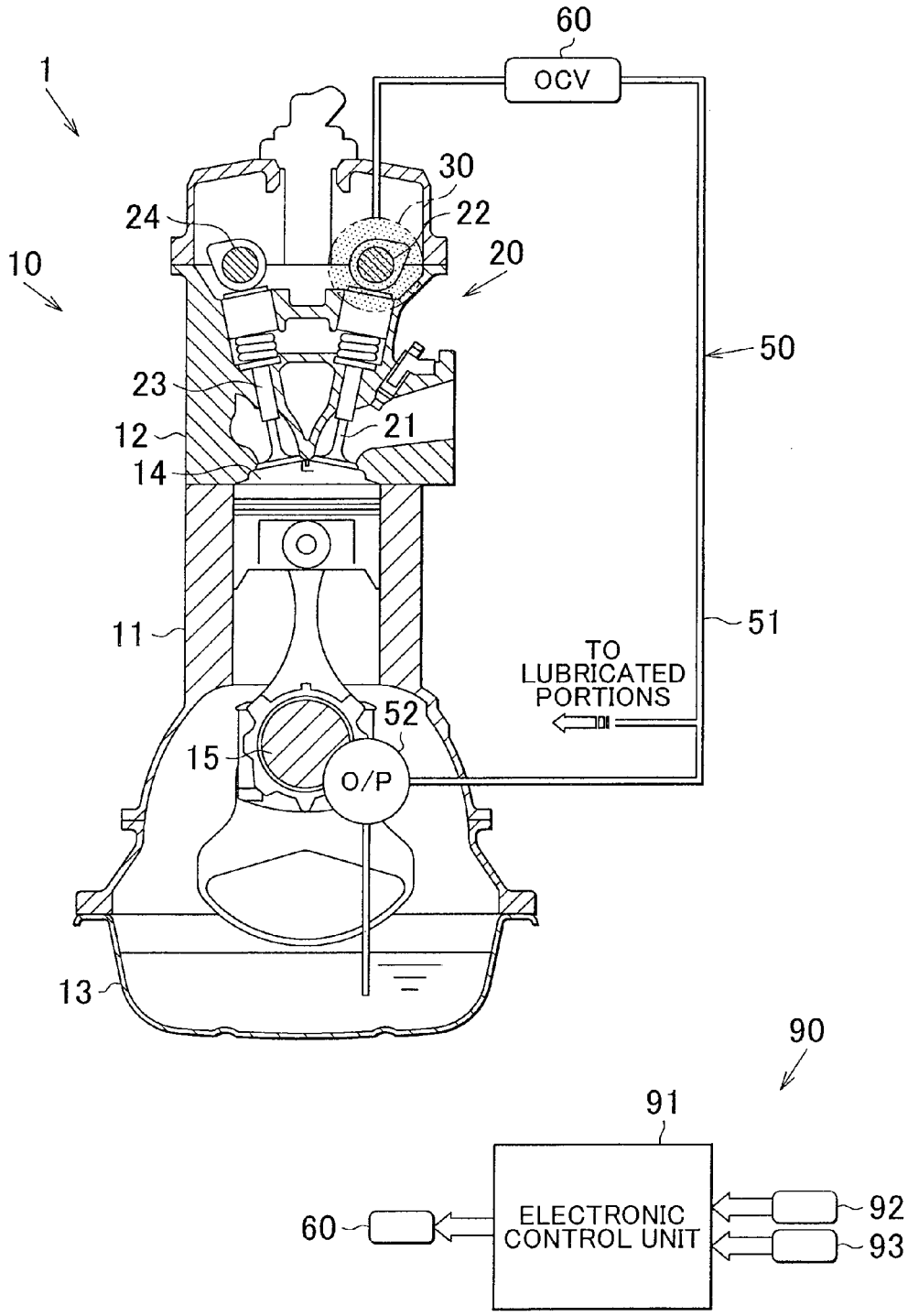
FIG. 1 is a schematic view of the configuration of an internal combustion engine according to an embodiment of the invention.

An embodiment of the invention will be described with reference to FIG. 1 to FIG. 11. FIG. 1 shows the overall configuration of an internal combustion engine. The internal combustion engine 1 includes an engine body 10, a variable valve timing device 20, a hydraulic control device 50 and a controller 90. The engine body 10 includes a cylinder block 11, a cylinder head 12 and an oil pan 13. The variable valve timing device 20 includes components of a valve train arranged in the cylinder head 12. The hydraulic control device 50 supplies hydraulic fluid (i.e. oil) hydraulic fluid) to the engine body 10, and the like. The controller 90 comprehensively controls these, devices.

The variable valve-timing device 20 is formed of intake valves 21, exhaust valves 23, an intake camshaft 22, an exhaust camshaft 24 and a variable valve-timing mechanism 30. The intake valves 21 and the exhaust valves 23 open or close corresponding combustion chambers 14. The intake camshaft 22 and the exhaust camshaft 24 respectively push down these valves. The variable valve-timing mechanism 30 varies the rotational phase (hereinafter, "valve-timing VT") of the intake camshaft 22 with respect to a crankshaft 15.

The hydraulic control device 50 includes an oil pump 52, a oil passage 51 and an oil control valve 60. The oil pump 52 discharges oil collected in the oil pan 13. The oil passage 51 supplies oil, discharged from the oil pump 52, to various portions of the internal combustion engine 1. The oil control valve 60 controls a mode in which oil is supplied to the variable valve-timing mechanism 30.

The controller 90 includes an electronic control unit 91 and various sensors, such as a crank position sensor 92 and a cam position sensor 93. The electronic control unit 91 executes various processes to control, for example, the operation of the internal combustion engine. The crank position sensor 92 outputs a signal that indicates the rotational angle of the crankshaft 15 to the electronic control unit 91. The cam position sensor 93 outputs a signal that indicates the rotational angle of the intake camshaft 22 to the electronic control unit 91.

The electronic control unit 91 calculates the following values as parameters used in various controls. Specifically, a value that indicates the rotational angle of the crankshaft 15 (hereinafter, "crank angle signal CA") is calculated based on the signal output from the crank position sensor 92. In addition, a value that indicates the rotational angle of the intake camshaft 22 (hereinafter, "intake cam angle signal DA") is calculated based on the signal output from the cam position sensor 93. Furthermore, a value that indicates the valve timing VT (hereinafter, "actual phase angle VTR") is calculated based on the crank angle signal CA and the intake cam angle signal DA.

Controls executed by the electronic control unit 91 include a valve-timing control, through which the variable valve-timing mechanism 30 is controlled to adjust the valve timing VT. In the valve-timing control, the valve timing VT is changed between the most advanced valve timing VT (hereinafter, "VTmax") and the most retarded valve timing VT (hereinafter, "VTmin") in accordance with the engine operating state. In addition, the valve timing VT is changed to VTmin (specific phase) when the internal combustion engine 1 is stopped.

Figure 2A:
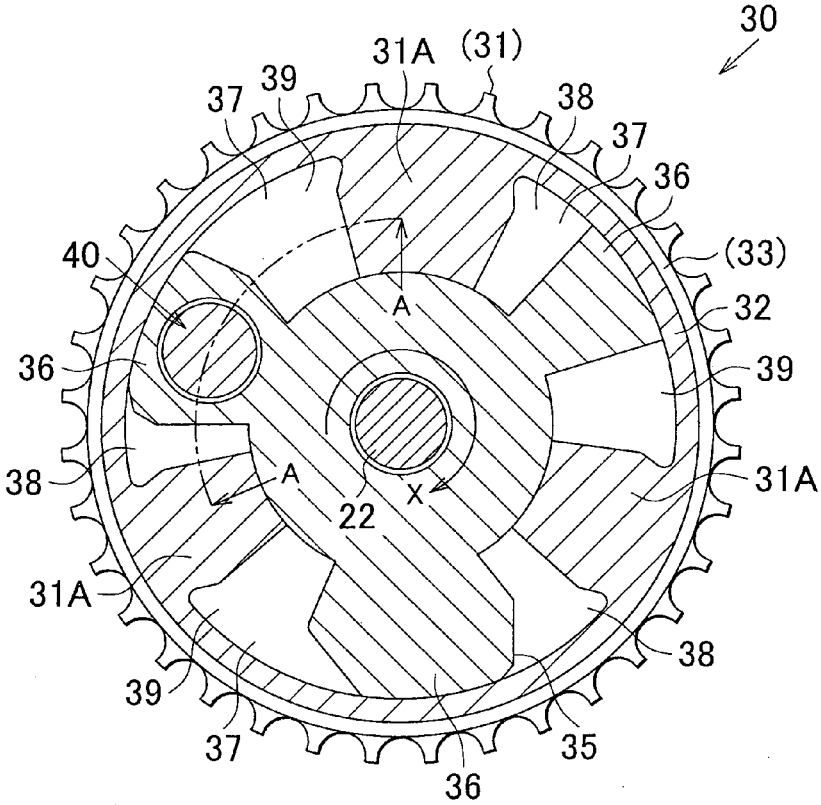
FIG. 2A is a sectional view of the structure of a variable valve timing mechanism according to the embodiment.
Figure 2B:
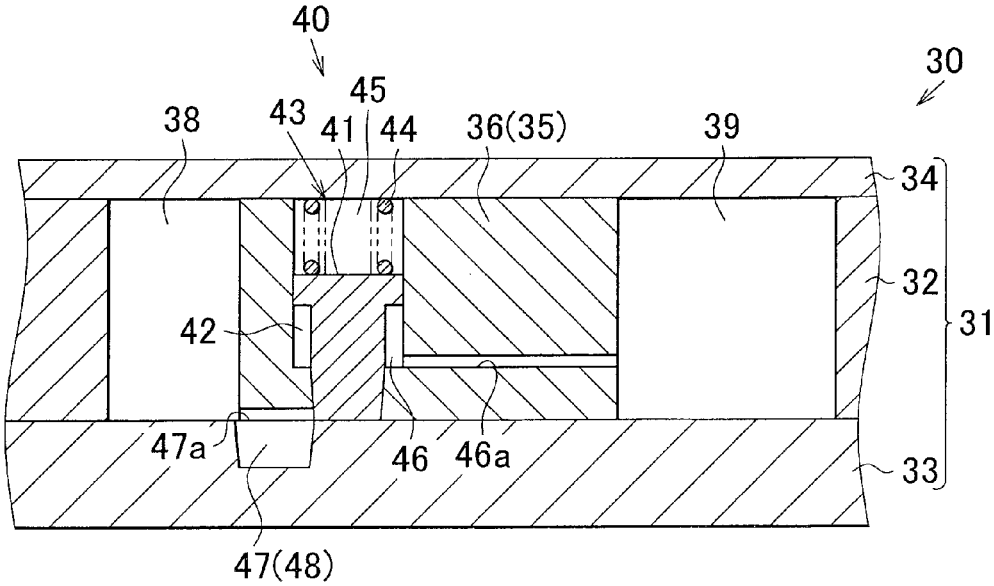
FIG. 2B is a sectional view of the structure, taken along the line A-A in FIG. 2A.

The configuration of the variable valve timing mechanism 30 will be described with reference to FIG. 2A and FIG. 2B. Note that the arrow X in the drawing indicates the rotational direction X of the crankshaft 15 (sprocket 33) and intake camshaft 22.

The variable valve-timing mechanism 30 includes a housing rotor 31, a vane rotor 35 and a phase locking mechanism 40. The housing rotor 31 rotates in synchronization with the crankshaft 15. The vane rotor 35 rotates in synchronization with the intake camshaft 22. The phase locking mechanism 40 locks the valve timing VT to VTmax.

The housing rotor 31 is formed of the sprocket 33, a housing body 32 and a cover 34. The sprocket 33 is coupled to the crankshaft 15 via a timing chain. The housing body 32 is inside of the sprocket 33, and rotates integrally with the sprocket 33. The cover 34 is attached to the housing body 32. The housing body 32 includes three partition walls 31A that project radially toward the rotary shaft (intake camshaft 22) of the housing rotor 31.

The vane rotor 35 is fixed to one end of the intake camshaft 22, and is arranged in a space inside the housing body 32. The vane rotor 35 has three vanes 36 that protrude into respective vane accommodating chambers 37. The vane accommodating chambers 37 are each formed between the adjacent partition walls 31A of the housing body 32. Each vane 36 partitions the corresponding vane accommodating chamber 37 into an advance chamber 38 and a retard chamber 39.

Each advance chamber 38 is located on a following side in the rotation direction X of the intake camshaft 22 with respect to the vane 36. Each retard chamber 39 is located on a preceding side in the rotation direction X of the intake camshaft 22. The volume of each advance chamber 38 and the volume of each retard chamber 39 varies with a state where oil is supplied to the variable valve-timing mechanism 30 by the oil control valve 60.

The operation of the variable valve-timing mechanism 30 will be described. When oil is supplied to the advance chambers 38 and drained from the retard chambers 39, the advance chambers 38 expand and the retard chambers 39 contract, which causes the vane rotor 35 to rotate toward an advance side with respect to the housing rotor 31, that is, in the rotation direction X of the intake camshaft 22. Thus, the valve timing VT is advanced. When the vane rotor 35 is fully rotated toward the advance side with respect to the housing rotor 31, that is, when the rotational phase of the vane rotor 35 with respect to the housing rotor 31 is set at the most preceding side in the rotation direction X, the valve timing VT is set to VTmax.

When oil is drained from the advance chambers 38 and supplied to the retard chambers 39, the retard chambers 39 expand and the advance chambers 38 contract, which causes the vane rotor 35 to rotate toward a retard side with respect to the housing rotor 31, that is, in the direction opposite to the rotation direction X of the intake camshaft 22. Thus, the valve timing VT is retarded. When the vane rotor, 35 is fully rotated toward the retard side with respect to the housing rotor 31, that is, when the rotational phase of the vane rotor 35 with respect to the housing rotor 31 is set at the most following side in the rotation direction X (hereinafter, "most retarded phase PB"), the valve timing VT is set to VTmin.

Figure 3:
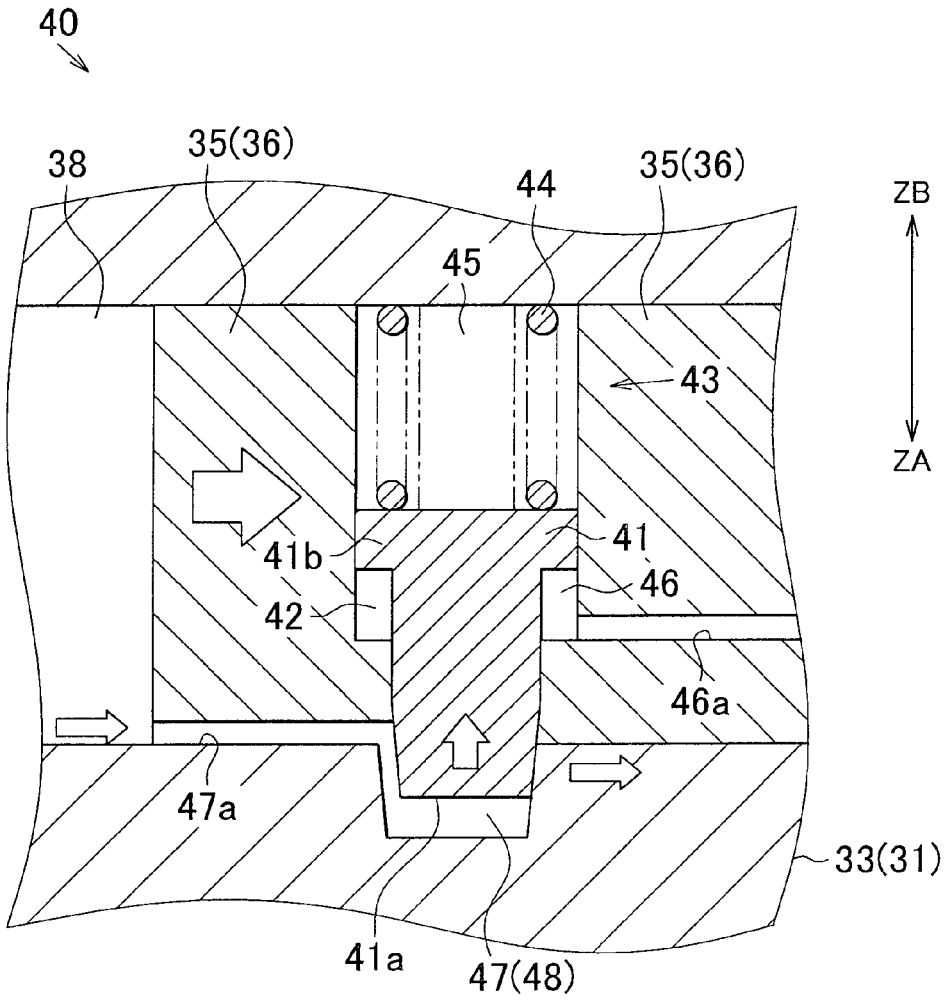
FIG. 3 is a sectional view of the structure of a phase locking mechanism according to the embodiment.

The structure of the phase locking mechanism 40 will be described with reference to FIG. 3. The phase locking mechanism 40 is formed of a restricting pin 41, an accommodating chamber 42, an engaging hole 48 and an actuating portion 43. The restricting pin 41 is provided for one of the vanes 36. The accommodating chamber 42 accommodates the restricting pin 41. The engaging hole 48 engages the restricting pin 41. The actuating portion 43 actuates the restricting pin 41. The engaging hole 48 is provided on the wall surface of the sprocket 33 at a position that corresponds to the location of the restricting pin 41 when the vane rotor 35 is rotated to the most retarded phase PB with respect to the housing rotor 31.

The actuating portion 43 includes a restricting spring 44, a spring chamber 45, a retard release chamber 46 and an advance release chamber 47. The restricting spring 44 is provided in the vane 36 and presses the restricting pin 41 in one direction. The spring chamber 45 is formed in the vane 36 and accommodates the restricting spring 44. The retard release chamber 46 is formed in the vane 36 and is used to actuate the restricting pin 41. The advance release chamber 47 is formed in the sprocket 33 and is used to actuate the restricting pin 41.

The retard release chamber 46 is surrounded by a sliding portion 41*b* of the restricting pin 41, a side surface of the restricting pin 41 and a wall surface of the accommodating chamber 42 that accommodates the restricting pin 41. A retard communication passage 46*a* is open at the wall surface of the accommodating chamber 42. The retard communication passage 46*a* provides fluid communication between the retard chamber 39 and the retard release chamber 46. Oil is supplied to the retard release chamber 46 through the retard communication passage 46*a*. When oil is supplied to the retard release chamber 46, hydraulic pressure is applied to the sliding portion 41*b* of the restricting pin 41, so the restricting pin 41 is displaced in a direction to be accommodated in the vane 36 (hereinafter, "accommodating direction ZB") against the force of the restricting spring 44. Because the retard release chamber 46 is in fluid communication with one of the retard chambers 39, when oil is supplied to the retard chamber 39, the restricting pin 41 is displaced in the accommodating direction ZB.

The internal space of the engaging hole 48 serves as the advance release chamber 47. An advance communication passage 47*a* is open to the advance release chamber 47. The advance communication passage 47*a* provides fluid communication between the advance release chamber 47 and one of the advance chambers 38. Oil is supplied to the advance release chamber 47 through the advance communication passage 47*a*. When oil is supplied to the advance release chamber 47, hydraulic pressure is applied to the distal end surface 41*a* of the restricting pin 41, so the restricting pin 41 is displaced in the accommodating direction ZB. Because the advance release chamber 47 is in fluid communication with one of the advance chambers 38, when oil is supplied to the advance chambers 38, the restricting pin 41 is displaced in the accommodating direction ZB.

If no oil is supplied to the retard release chamber 46 or the advance release chamber 47, the restricting pin 41 is displaced in a direction to project from the vane 36 (hereinafter, "projecting direction ZA") by the force of the restricting spring 44. While the force in the projecting direction ZA is exerted on the restricting pin 41, when the vane rotor 35 rotates with respect to the housing rotor 31 and then the restricting pin 41 is displaced to the engaging hole 48, the restricting pin 41 is pushed into the engaging hole 48. Thus, the housing rotor 31 is fixed to the vane rotor 35.

The correlation between the operation of the variable valve-timing mechanism 30 and the operation of the phase locking mechanism 40 will be described next. When a request to advance the valve timing VT is detected, oil is supplied to the advance chambers 38 by the hydraulic control device 50. At this time, oil is also supplied to the advance release chamber 47. Therefore, with the restricting pin 41 is accommodated in the accommodating chamber 42, the vane rotor 35 rotates toward the advance side with respect to the housing rotor 31.

The hydraulic control device 50 supplies oil to the retard chambers 39 when a request to retard the valve timing VT is detected. At this time, oil is also supplied to the retard release chamber 46. Therefore, if the restricting pin 41 is accommodated in the accommodating chamber 42, the vane rotor 35 rotates toward the retard side with respect to the housing rotor 31.

When there is a request to fully retard the valve timing VT at the time of stop of the engine, the hydraulic control device 50 continues to supply oil to the retard chambers 39. Thus, the vane rotor 35 rotates toward the retard side with respect to the housing rotor 31. In addition, hydraulic pressure gradually decreases with a decrease in the rotation of the oil pump 52 due to stopping of the engine. Therefore, the hydraulic pressure in the advance release chamber 47 and the hydraulic pressure in the retard release chamber 46 decrease, so the restricting pin 41 is urged in the projecting direction ZA. When the rotational phase of the vane rotor 35 with respect to the housing rotor 31 is the most retarded phase PB, the restricting pin 41 is fitted into the engaging hole 48. Thus, the valve timing VT is locked to VTmin.

Figure 4:
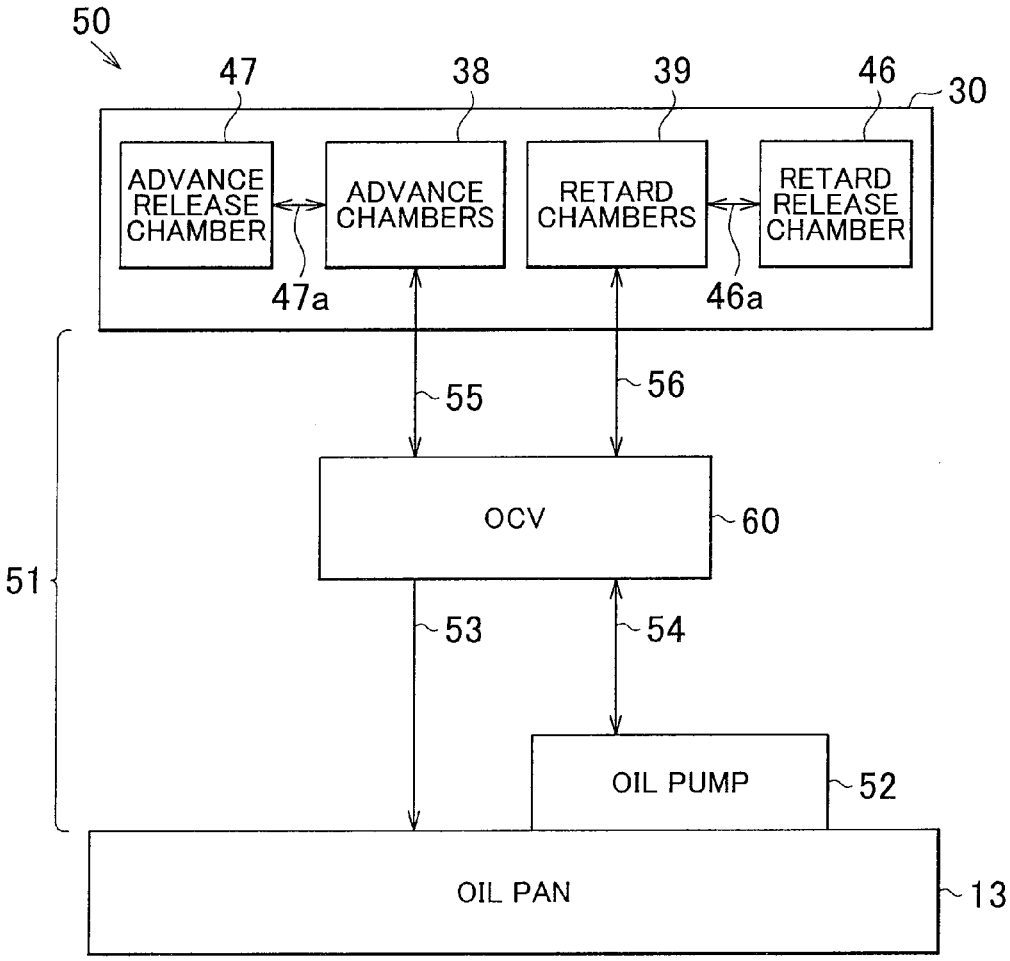
FIG. 4 is a schematic view of a hydraulic control device according to the embodiment.

How the lubricating oil is supplied by the hydraulic control device 50 will be described with reference to FIG. 4. The variable valve-timing mechanism 30 includes two types of hydraulic chambers, specifically, the advance chambers 38 and the retard chambers 39, of which a state where lubricating oil is supplied and a state where lubricating oil is drained are switched by the hydraulic control device 50. One of the advance chambers 38 is in fluid communication with the advance release chamber 47 via the advance communication passage 47*a*. One of the retard chambers 39 is in fluid communication with the retard release chamber 46 via the retard communication passage 46*a*.

Oil discharged from the oil pump 52 is supplied to the oil control valve 60 via an oil supply passage 54 or an oil feed passage. The flow of oil through the oil passage 51 is controlled in accordance with the operation mode of the oil control valve 60, as described below.

When the oil control valve 60 operates in a first operation mode (hereinafter, "first mode MD1"), oil is supplied to the advance chambers 38 and drained from the retard chambers 39. In particular, the oil is supplied to the advance chambers 38 via an advance oil passage 55, and oil in the retard chambers 39 is drained via a retard oil passage 56. Oil that is drained from the retard chambers 39 is returned to the oil pan 13 via the oil control valve 60 and an oil drain passage 53.

When the oil control valve 60 operates in a second operation mode (hereinafter, "second mode MD2") oil is supplied to the advance chambers 38 and the flow of oil to the retard chambers 39 is interrupted. In particular, the oil is supplied to the advance chambers 38 via an advance oil passage 55, and the retard oil passage 56 is closed.

When the oil control valve 60 operates in a third operation mode (hereinafter, "third mode MD3), the supply of oil to the advance chambers 38 is interrupted and to the retard chambers 39 is interrupted by closing the retard oil passage 56 and the advance oil passage 55. That is, the hydraulic pressure in the advance chambers 38 and the hydraulic pressure in the retard chambers 39 are maintained constant.

When the oil control valve 60 operates in a fourth operation mode (hereinafter, "fourth mode MD4"), the flow of oil to the advance chambers 38 is interrupted and oil is supplied to the retard chambers 39. Specifically, oil is supplied to the retard chambers 39 via the retard oil passage 56, and the advance oil passage 55 is closed.

When the oil control valve 60 operates in a fifth operation mode (hereinafter, "fifth mode MD5"), oil is drained from the advance chambers 38 and supplied to the retard chambers 39. Specifically, oil is drained from the advance chambers 38 via the advance oil passage 55, and oil is supplied to the retard chambers 39 via the retard oil passage 56. The oil drained from the advance chambers 38 is returned to the oil pan 13 via the oil control valve 60 and the oil drain passage 53.

The structure of the oil control valve 60 will be described with reference to FIG. 5A to FIG. 5C. The oil control valve 60 includes a sleeve 61 and a spool 62. The sleeve 61 has a plurality of ports. The spool 62 is provided within the sleeve 61. The spool 62 is displaced with respect to the sleeve 61 to change the fluid communication state among the ports to thereby regulate the flow of oil to or from the advance chambers 38 and the retard chambers 39.

An advance port 61*a*, a retard port 61*b*, a supply port 61*c*, a first drain port 61*d* and a second drain port 61*e* are formed in the sleeve 61. The advance port 61*a* is connected to the advance oil passage 55. The retard port 61*b* is connected to the retard oil passage 56. The supply port 61*c* is connected to the oil supply passage 54. The first drain port 61*d* is connected to the oil, drain passage 53. The second drain port 61*e* is connected to the oil drain passage 53.

A spool spring 63 is provided at the distal end of the spool 62. The spool spring 63 presses the spool 62 toward the retard port 61*b*. A drive mechanism is provided at the proximal portion of the spool 62. The drive mechanism actuates the spool 62 against the spool spring 63. The drive mechanism actuates the spool 62 based on the duty ratio output from the electronic control unit 91.

The following valve elements in the spool 62 vary the openings of the respective ports as the spool 62 is displaced with respect to the sleeve 61. That is, the spool 62 includes an advance valve 64, a retard valve 65 and a shut off valve 66. The advance valve 64 varies the openings of the supply port 61*c*, first drain port 61*d* and advance port 61*a*. The retard valve 65 varies the openings of the supply port 61*c*, retard port 61*b* and second drain port 61*e*. The shut off valve 66 is provided at one end of the spool 62.

The oil control valve 60 is displaced in the axial direction of the spool 62 with respect to the sleeve 61 to change the state where oil flows to or from the advance chambers 38 and the retard chambers 39 to any one of the first mode MD1 to the fifth mode MD5.

The correlation between each operation mode and the position of the spool 62 will be described with reference to FIG. 5A to FIG. 6B. Note that a first position PS1 to a fourth position PS4 do not indicate predetermined positions but indicate positional relationships that satisfy the following states where oil flows to or from the advance chambers 38 and the retard chambers 39 at the respective positions.

Figure 5A:
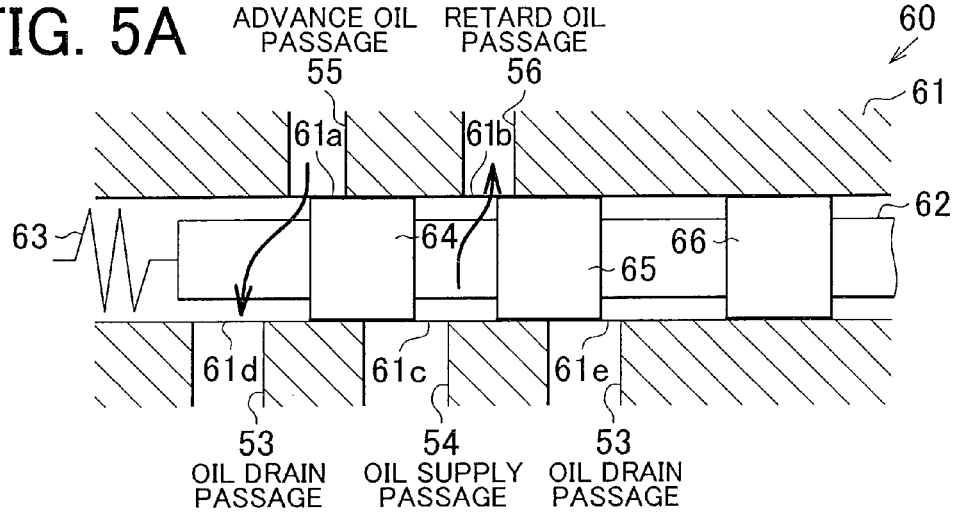
FIG. 5A, FIG. 5B and FIG. 5C are sectional views of the structure of an oil control valve according to the embodiment.

As shown in FIG. 5A, when the oil control valve 60 operates in the fifth mode MD5, the spool 62 is in the first position PS1 with respect to the sleeve 61, and the following fluid communication state is maintained among the ports. That is, fluid communication is established between the advance port 61*a* and the first drain port 61*d*, and between the retard port 61*b* and the supply port 61*c*. The above fluid communication state is established among the ports, so oil is drained from the advance chambers 38, and oil is supplied to the retard chambers 39.

Figure 5B:
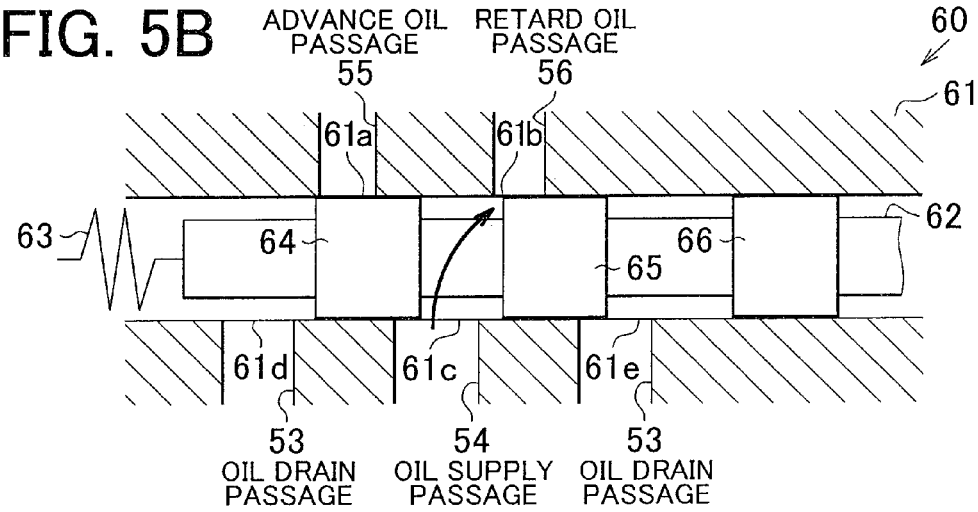

As shown in FIG. 5B, when the oil control valve 60 operates in the fourth mode MD4, the spool 62 is in the second position PS2 with respect to the sleeve 61, and the following fluid communication state is maintained among the ports. That is, the advance port 61*a* is shut off by the advance valve 64, and fluid communication between the retard port 61*b* and the supply port 61*c* is established. The opening area of the retard port 61*b* at this time is smaller than that in the fifth mode MD5. Accordingly, the flow of oil to the advance chambers 38 is interrupted, and a slight amount of oil is supplied to the retard chambers 39.

Figure 5C:
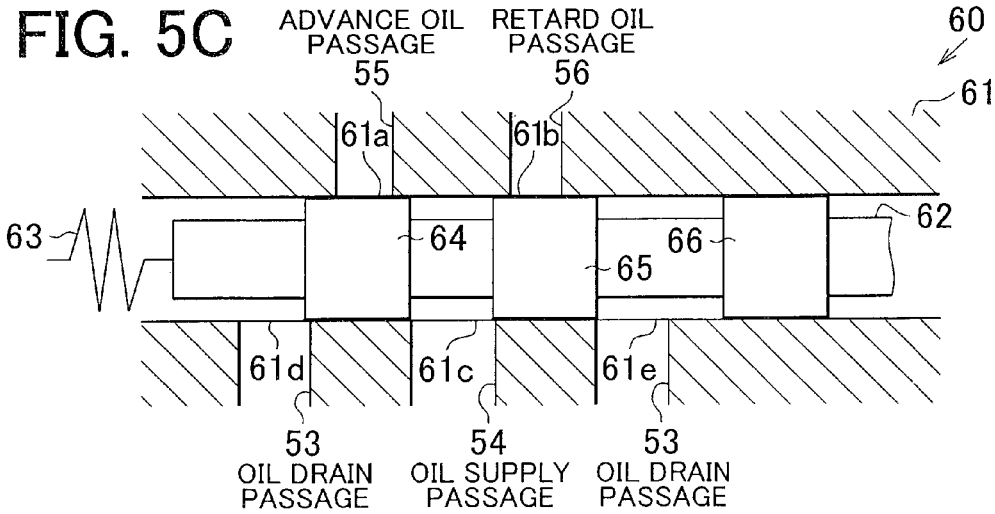

As shown in FIG. 5C, when the oil control valve 60 operates in the third mode MD3, the spool 62 is in the third position PS3 with respect to the sleeve 61, and the following fluid communication state is maintained among the ports. That is, the advance port 61*a* is shut off by the advance valve 64, and the retard port 61*b* is shut off by the retard valve 65. Accordingly, the hydraulic pressure in the advance chambers 38 and the hydraulic pressure in the retard chambers 39 are maintained.

Figure 6A:
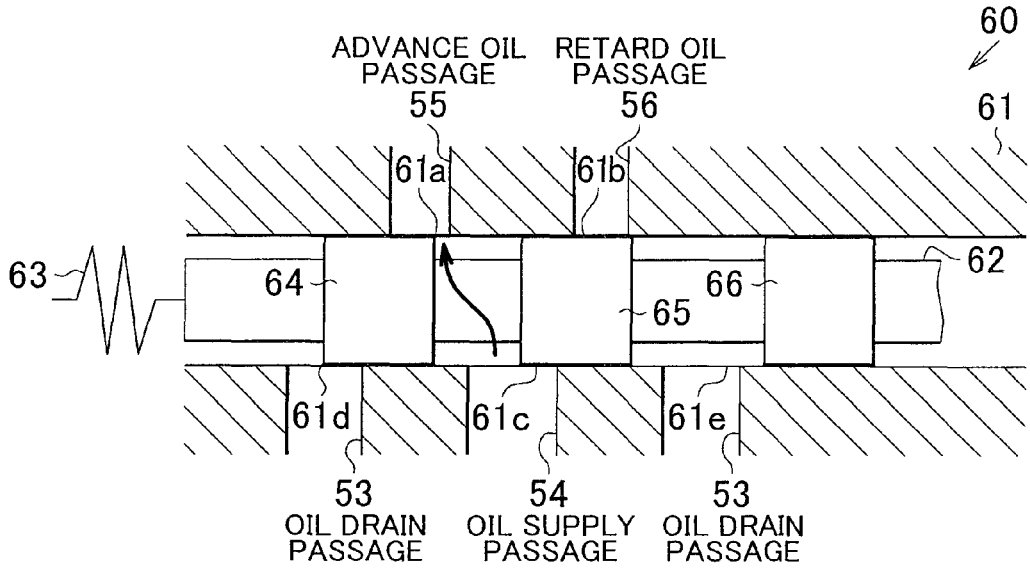
FIG. 6A and FIG. 6B are sectional views of the structure of the oil control valve according to the embodiment.

As shown in FIG. 6A, when the oil control valve 60 operates in the second mode MD2, the spool 62 is in the fourth position PS4 with respect to the sleeve 61, and the following fluid communication state is maintained among the ports. Specifically, fluid communication is established between the advance port 61*a* and the supply port 61*c*, and the retard port 61*b* is shut off by the retard valve 65. The opening area of the advance port 61*a* at this time is smaller than that in the first mode MD1, which will be described below. When the above fluid communication state is established among the ports, oil is supplied to the advance chambers 38, and flow of oil to the retard chambers 39 is interrupted.

Figure 6B:
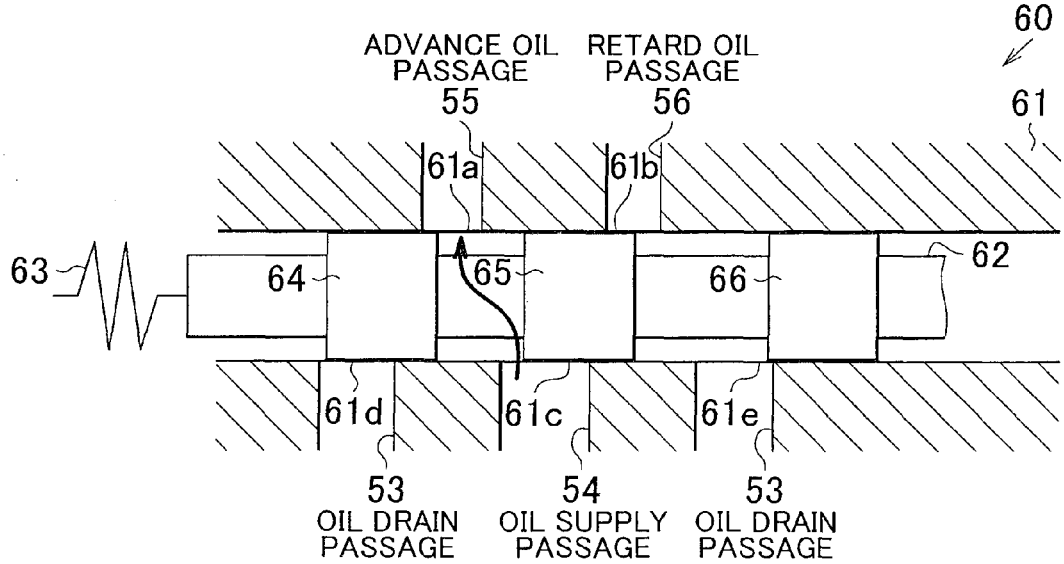

As shown in FIG. 6B, when the operation of the oil control valve 60 is set to the first mode MD1, the position of the spool 62 with respect to the sleeve 61 is the fifth position PS5, and the following fluid communication state is established among the ports. Specifically, fluid communication is established between the advance port 61*a* and the supply port 61*c*, and between the retard port 61*b* and the second drain port 61*e*. When the above fluid communication state is established among the ports, oil is supplied to the advance chambers 38, and drained from the retard chambers 39.

Figure 7:
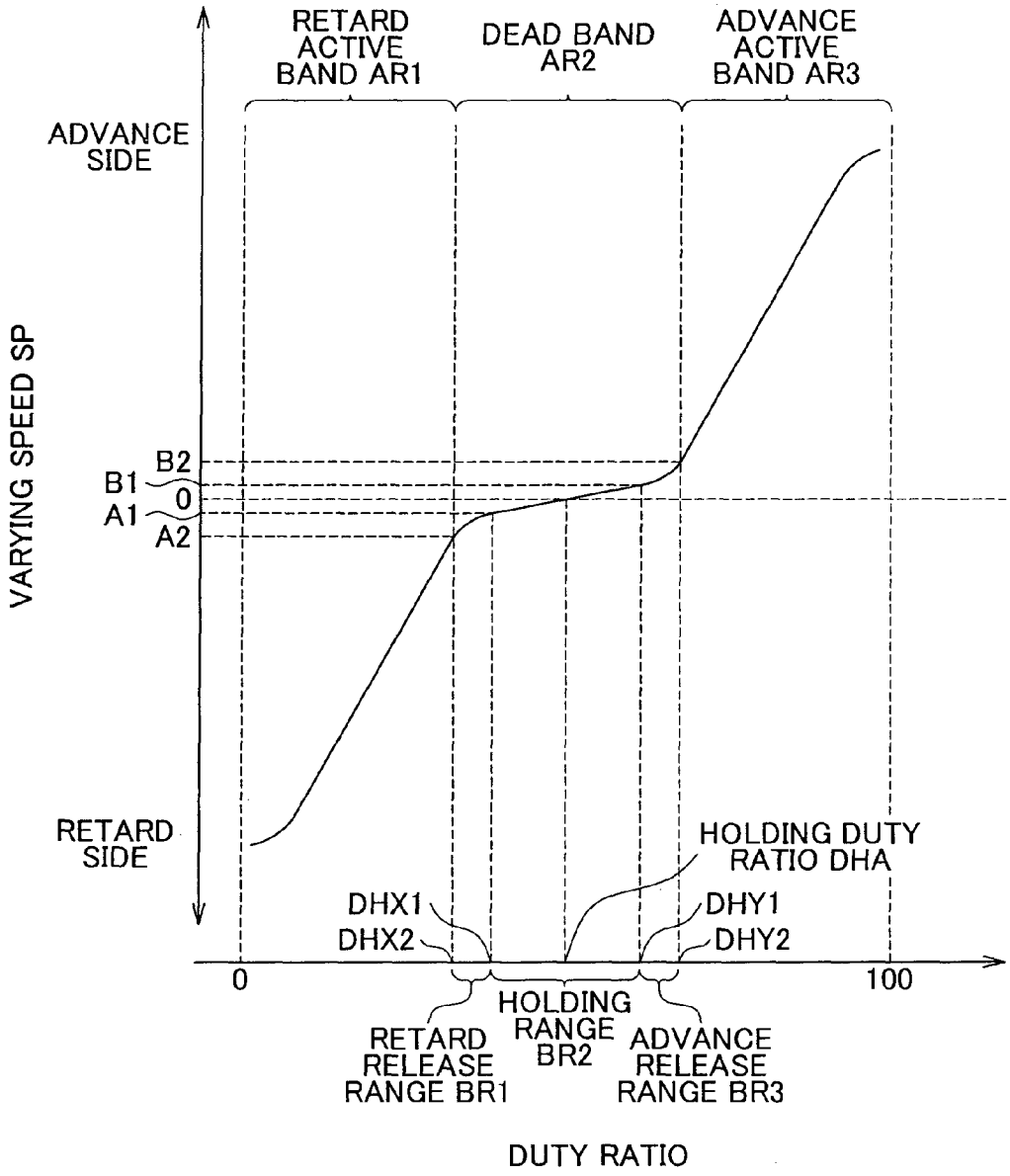
FIG. 7 is a graph that shows the correlation between a duty ratio and a varying speed in the oil control valve according to the embodiment.

The correlation between a duty ratio input to the oil control valve 60 and a varying speed SP of the valve timing VT will be described with reference to FIG. 7. Note that the duty ratio correlates with the spool position. The range in which the duty ratio is set is separated into a retard active band AR1, a dead band AR2 and an advance active band AR3.

The dead band AR2 is further separated into a retard release range BR1, a holding range BR2 and an advance release range BR3. These ranges are separated based on the rate of change in the varying speed SP of the valve timing VT. Note that the dead band AR2 indicates a range in which, at the retard side, the rate of change in the varying speed SP of the valve timing VT with respect to the duty ratio is lower than that in the retard active band AR1 and, at the advance side, the rate of change in the varying speed SP of the valve timing VT with respect to the duty ratio is lower than that in the advance active band AR3.

The retard active band AR1 is a range in which the varying speed SP at which the valve timing VT is retarded is higher than a predetermined varying speed (hereinafter, "second retard speed A2"). When the duty ratio is set within the retard active band AR1, the spool 62 is placed at the first position PS1, and the oil control valve 60 is driven in the fifth mode MD5.

The retard release range BR1 is a range in which the varying speed SP at which the valve timing VT is retarded is equal to or exceeds a predetermined varying speed (hereinafter, "first retard speed A1") and is equal to or below the second retard speed A2. That is, if the duty ratio at which the valve timing VT is changed at the first retard speed A1 is a first retard duty ratio DHX1 and the duty ratio at which the valve timing VT is changed at the second retard speed A2 is a second retard duty ratio DHX2, the retard release range BR1 is defined by the range between the second retard duty ratio DHX2 and the first retard duty ratio DHX1. When the duty ratio is set within the retard release range BR1, the spool 62 is placed at the second position PS2, and the oil control valve 60 is driven in the fourth mode MD4.

The holding range BR2 is a range that includes a range in which the varying speed SP at which the valve timing VT is retarded is below the first retard speed A1 and a range in which the varying speed SP at which the valve timing VT is advanced is below a predetermined varying speed (hereinafter, "first advance speed B1"). When the duty ratio is set so as to decrease within the holding range BR2, the spool 62 is placed at the third position PS3, and the oil control valve 60 is driven in the third mode MD3.

The advance release range BR3 is a range in which the varying speed SP at which the valve timing VT is advanced is equal to or exceeds the first advance speed B1 and equal or below to a predetermined varying speed (hereinafter, "second advance speed B2"). That is, if the duty ratio at which the valve timing VT is changed at the first advance speed B1 is a first advance duty ratio DHY1 and the duty ratio at which the valve timing VT is changed at the second advance speed B2 is a second advance duty ratio DHY2, the advance release range BR3 is defined by the range between the second retard duty ratio DHX2 and the first retard duty ratio DHX1. When the duty ratio is set within the advance release range BR3, the spool 62 is placed at the fourth position PS4, and the oil control valve 60 is driven in the second mode MD2.

The advance active band AR3 is a range in which the varying speed SP at which the valve timing VT is advanced is higher than the second advance speed B2. When the duty ratio is set within the advance active band AR3, the spool 62 is placed at the fifth position PS5, and the oil control valve 60 is driven in the first mode MD1.

The correlation between the varying speed SP of the valve timing VT and the operation of the oil control valve 60 is as follows. When the duty ratio falls within the retard active band AR1, the varying speed SP at which the valve timing VT is retarded increases as the duty ratio decreases. The above operation is due to the following reason. When the duty ratio falls within the retard active band AR1, the oil control valve 60 is driven in the fifth mode MD5. As the duty ratio is increased within the above range, the opening of the advance port 61*a* and the retard port 61*b* increase, so the rotation speed at which the vane rotor 35 rotates toward the retard side increases.

The rate of change in the varying speed SP with respect to the duty ratio when the duty ratio falls within the retard release range BR1 is lower than that when the duty ratio falls within the retard active band AR1. The above operation is due to the following reason. When the duty ratio falls within the retard release range BR1, the oil control valve 60 is driven in the fourth mode MD4. In the fourth mode MD4, oil is supplied to the retard port 61*b*, while the advance port 61*a* is shut off to retain oil in the advance chambers 38, so the rotation of the vane rotor 35 is inhibited.

The rate of change in the varying speed SP with respect to the duty ratio when the duty ratio falls within the holding range BR2 is lower than that when the duty ratio falls within the retard active band AR1, the retard release range BR1, the advance release range BR3 or the advance active band AR3.

That is, when the oil control valve 60 is driven in the third mode MD3, the advance port 61*a* is shut off by the advance valve 64, and the retard port 61*b* is shut off by the retard valve 65. However, when the advance port 61*a* and the retard port 61*b* are shut off in this way, a slight amount of oil leaks through a gap between the advance valve 64 and the advance port 61*a* or a gap between the retard valve 65 and the retard port 61*b*. Therefore, when the duty ratio falls within the holding range BR2 and the duty ratio deviates from a holding duty ratio DHA, the vane rotor 35 rotates toward the advance side or the retard side. Note that the holding duty ratio DHA is defined as a duty ratio at which the position of the vane rotor 35 does not change.

The rate of change in the varying speed SP with respect to the duty ratio when the duty ratio falls within the advance release range BR3 is lower than that when the duty ratio falls within the advance active band AR3. The above operation is due to the following reason. When the duty ratio falls within the advance release range BR3, the oil control valve 60 is driven in the second mode MD2. In the second mode MD2, oil is supplied to the advance port 61*a*, while the retard port 61*b* is shut off to retain oil in the retard chambers 39, so the rotation of the vane rotor 35 is inhibited.

When the duty ratio falls within the advance active band AR3, the varying speed SP at which the valve timing VT is advanced increases as the duty ratio increases. The above operation is due to the following reason. When the duty ratio falls within the advance active band AR3, the oil control valve 60 is driven in the first mode MD1. As the duty ratio is increased within the above range, the opening of the advance port 61*a* and of the retard port 61*b* increase, so the vane rotor 35 rotates toward the advance side at a higher speed.

Figure 8A:
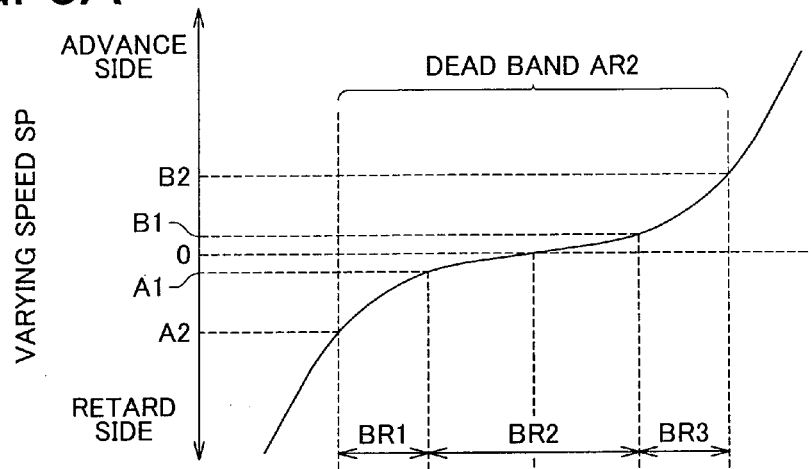
FIG. 8A, FIG. 8B and FIG. 8C are graphs that show the correlation among a varying speed of the valve timing, a displacement speed of a restricting pin and the pressing force with which the restricting pin is pressed against an engaging hole in the oil control valve according to the embodiment.
Figure 8B:
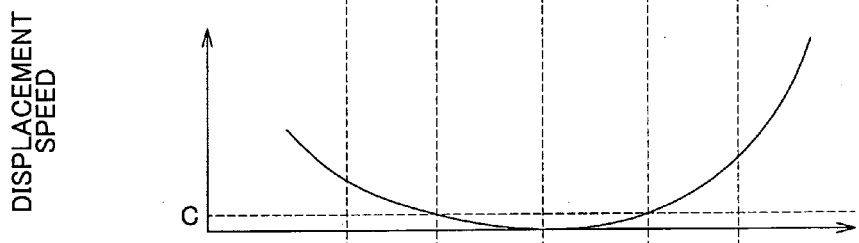
Figure 8C:
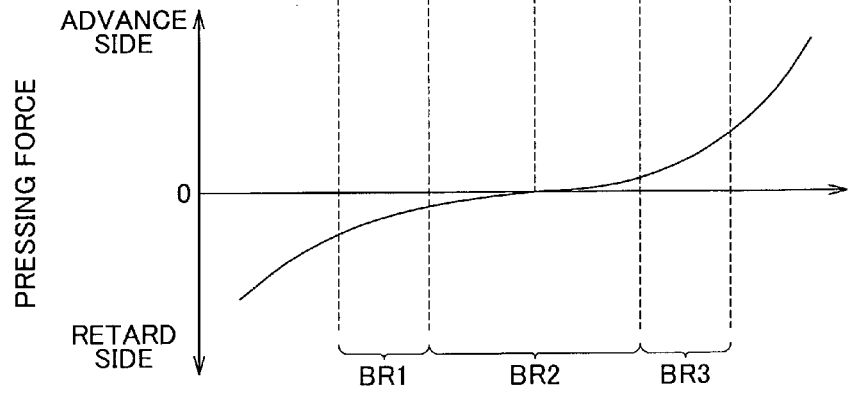

The correlation among a duty ratio input to the oil control valve 60, a displacement speed of the restricting pin 41 and a pressing force (engaging force) with which the restricting pin 41 is pressed into the engaging hole 48 will be described with reference to FIG. 8A to FIG. 8C. FIG. 8A is a partially enlarged graph of FIG. 7. FIG. 8B is a graph that shows a displacement speed of the restricting pin 41 with respect to a duty ratio. FIG. 8C is a graph that shows a pressing force with which the restricting pin 41 is pressed into the engaging hole 48.

When the duty ratio falls within the retard active band AR1, the oil control valve 60 is driven in the fifth mode MD5. At this time, the opening of the advance port 61*a* and of the retard port 61*b* are larger than those in the fourth mode MD4. Therefore, the vane rotor 35 rotates toward the retard side at a higher speed than in the fourth mode MD4. When the restricting pin 41 is accommodated in the accommodating chamber 42, the pressing force with which the restricting pin 41 is pressed into the accommodating chamber 42 in the fifth mode MD5 is higher than that in the fourth mode MD4. Therefore, when the rotation of the vane rotor 35 in the retard direction is accelerated before the restricting pin 41 is accommodated in the accommodating chamber 42, it is more difficult to withdraw the restricting pin 41 from the engaging hole 48.

Note that the variable valve-timing mechanism 30 locks the valve timing VT to VTmin, so the vane rotor 35 is not rotated toward the retard side in the fifth mode MD5 in a state where the restricting pin 41 engages the engaging hole 48. However, if the duty ratio falls within the retard active band AR1 when the valve timing VT is at VTmin, it is difficult to withdraw the restricting pin 41 from the engaging hole 48.

When the duty ratio falls within the retard release range BR1, the oil control valve 60 is driven in the fourth mode MD4. At this time, the opening of the retard port 61*b* is smaller than that in the fifth mode MD5 and the advance port 61*a* is shut off. Therefore, the vane rotor 35 rotates toward the retard side at a lower speed than in the fifth mode MD5. When the restricting pin 41 engages the engaging hole 48, the pressing force by which the restricting pin 41 is pressed into the engaging hole 48 in the fourth mode MD4 is lower than that in the fifth mode MD5. For this reason, the restricting pin 41 is more easily withdrawn in the fourth mode MD4 than in the fifth mode MD5.

In addition, the opening of the retard port 61*b* is larger than that in the third mode MD3. Therefore, the displacement speed of the restricting pin 41 is higher than that in the third mode MD3. Therefore, the restricting pin 41 may be more quickly withdrawn from the engaging hole 48 than in the third mode MD3.

When the duty ratio falls within the holding range BR2, the oil control valve 60 is driven in the third mode MD3. At this time, because the advance port 61*a* and the retard port 61*b* are shut off and there is just a slight leakage, the opening areas of the advance port 61*a* and the retard port 61*b* are both smaller than those in the second mode MD2 or those in the fourth mode MD4. Therefore, the speed at which the vane rotor 35 rotates toward the retard side and the restricting pin 41 is displaced in the accommodating direction ZB is also lower than that in the fourth mode MD4. In addition, the speed at which the vane rotor 35 rotates toward the advance side and the restricting pin 41 is displaced in the accommodating direction ZB is also lower than that in the second mode MD2 as well.

When the duty ratio is set at the holding duty ratio DHA, the advance port 61*a* and the retard port 61*b* are shut off, so the position of the vane rotor 35 and the position of the restricting pin 41 with respect to the housing are maintained.

When the duty ratio falls within the advance release range BR3, the oil control valve 60 is driven in the second mode MD2. At this time, the opening of the advance port 61*a* is smaller than that in the first mode MD1, and the retard port 61*b* is shut off. Therefore, the speed at which the vane rotor 35 rotates toward the advance side is lower than that in the first mode MD1. When the restricting pin 41 engages the engaging hole 48, the pressing force with which the restricting pin 41 is pressed into the engaging hole 48 in the second mode MD2 is smaller than that in the first mode MD1. For this reason, the restricting pin 41 is more easily withdrawn in the second mode MD2 than in the first mode MD1.

In addition, the opening of the advance port 61*a* is larger than that in the third mode MD3. Therefore, the displacement speed of the restricting pin 41 is higher than that in the third mode MD3. Therefore, the restricting pin 41 may be withdrawn from the engaging hole 48 more quickly than in the third mode MD3.

When the duty ratio falls within the advance active band AR3, the oil control valve 60 is driven in the first mode MD1. At this time, the opening of the advance port 61*a* and of the retard port 61*b* are larger than those in the second mode MD2. Therefore, the speed at which the vane rotor 35 rotates toward the advance side is higher than that in the second mode MD2. When the restricting pin 41 has entered the accommodating chamber 42, the pressing force with which the restricting pin 41 is pressed against the accommodating chamber 42 in the first mode MD1 is larger than that in the second mode MD2. Therefore, when the rotation of the vane rotor 35 in the advance direction is accelerated before the restricting pin 41 enters the accommodating chamber 42, the restricting pin 41 is engaged with the engaging hole 48, as shown in FIG. 3, which makes it difficult to withdraw the restricting pin 41 from the engaging hole 48. In this case, the rotation of the vane rotor 35 in the advance direction is inhibited, so the advance of the valve timing. VT is delayed.

Next, valve-timing control for changing the valve timing VT to a target valve timing (hereinafter, "target phase angle VTT") will be described. The valve-timing control includes a feedback control, a hold learning control and a pre-control. The feedback control causes the actual phase angle VTR during the control to converge to the target phase angle VTT. In the hold learning control, the holding duty ratio DHA is learned. The pre-control is executed before the feedback control.

The feedback control is executed in the following manner. Based on the operating state and the engine load state, the target phase angle VTT appropriate for those states is obtained. In addition, the electronic control unit 91 obtains the actual phase angle VTR during the processing based on the crank angle signal CA and the intake cam angle signal DA. These values are updated at periodically. Accordingly, the differential phase VTD of the actual phase angle VTR with respect to the target phase angle VTT is determined, and the duty ratio of the oil control valve 60 is determined based on the differential phase VTD.

Figure 9:
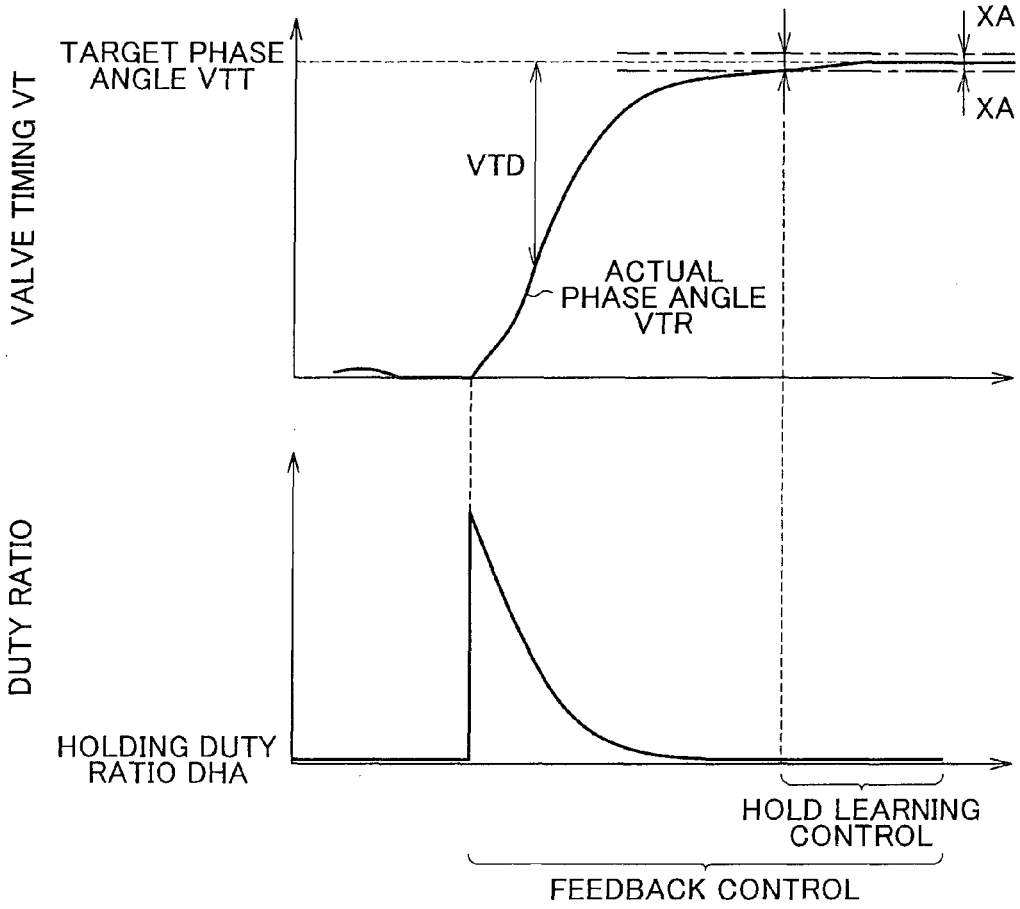
FIG. 9 is a timing chart that shows changes in the valve timing through feedback control over a variable valve timing apparatus according to the embodiment.

The correlation between an actual phase angle VTR and a duty ratio during feedback control will be described with reference to FIG. 9. The duty ratio is set more apart from the holding duty ratio DHA as the differential phase VTD of the actual phase angle VTR with respect to the target phase angle VTT increases. As the differential phase VTD of the actual phase angle VTR with respect to the target phase angle VTT decreases, the duty ratio is set closer to the holding duty ratio DHA. In addition, when the absolute value of the differential phase VTD of the actual phase angle VTR with respect to target phase angle VTT is below a threshold value (hereinafter, "deviation threshold value XA"), the duty ratio is set to the holding duty ratio DHA. The deviation threshold value XA is a preset value used to determine whether the actual phase angle VTR has converged to the target phase angle VTT.

Next, the hold learning control will be described. The holding duty ratio DHA varies depending on the engine operating state, that is, whether the engine is cold, warm, or is warmed-up. This is because the viscosity of oil and clearances between members of the variable valve-timing mechanism 30 vary depending on the engine operating state to vary the resistance of lubricating oil that flows through each port of the sleeve 61 and, as a result, driving force that displaces the spool 62 to a predetermined position varies. Accordingly, the hold learning control is periodically executed during engine operation.

The hold learning control includes initial learning that is performed when the engine is started and operational learning that is performed after the initial learning is complete. The duty ratio learned in initial learning is stored as a reference duty ratio DHK. As long as the engine is running, the reference duty ratio DHK is not changed. The duty ratio learned in operational learning is updated each time as the holding duty ratio DHA. The same method used for operational learning may also be used for initial learning; however, both learning methods differ from each other in learning timing and in whether it is updated.

The hold learning control is executed when it is determined that the differential phase VTD of the actual phase angle VTR with respect to the target phase angle VTT has remained smaller than the deviation threshold value XA for a predetermined period of time. That is, when the differential phase VTD of the actual phase angle VTR with respect to the target phase angle VTT falls below the deviation threshold value XA, the duty ratio at this time is temporarily stored. In the case of the operational learning, the stored duty ratio is used to update the holding duty ratio DHA. In the case of the initial learning, the stored duty ratio is set and saved as the reference duty ratio DHK.

Next, the pre-control will be described. The valve timing VT is changed with a variation in the operating state and a variation in the engine load regardless of whether the engine is being started, coldor some time after warm-up of the engine. When the engine is started, the valve timing VT is at VTmin. When the operating state and the engine load vary after the engine is started, the valve timing VT is advanced from VTmin to a predetermined valve timing VT. However, when the engine is started, the restricting pin 41 engages the engaging hole 48, so, when the valve timing VT is changed in accordance with the feedback control, the restricting pin 41 may engage the engaging hole 48 to inhibit the rotation of the vane rotor 35. In particular, when the target phase angle VTT is set apart from the most retarded timing VTmin, the duty ratio of the oil control valve 60 is set to a large value through feedback control to cause the oil control valve 60 to be driven in the first mode MD1, so that it is difficult to withdraw the restricting pin 41 from the engaging hole 48. Then, in order to suppress interference with the advance of the vane rotor 35 due to engagement of the restricting pin 41 and the engaging hole 48, the pre-control is executed before the feedback control. That is, in the pre-control, when there is a possibility that the restricting pin 41 is fitted in the engaging hole 48, that is, when the valve timing VT is VTmin, the second mode MD2 (advance release mode) is executed in accordance with the advance request to withdraw the restricting pin 41 from the engaging hole 48. Furthermore, it is determined whether the valve timing VT is at VTmin based on the actual phase angle VTR.

The valve-timing control executed including the pre-control, the feedback control and the hold learning control will be described with reference to FIG. 10. The pre-control includes step S110, step S140 and step S150. Note that the above process is executed by the electronic control unit 91 at a predetermined intervals.

In step S100, it is determined whether the initial release is complete. The initial release is completed when the restricting pin 41 has been withdrawn from the engaging hole 48 by setting the oil control valve 60 in the second mode MD2 (advance release mode) after the engine has started.

When the initial release has not yet completed, control of step S101 to step S103 is executed. That is, in step S101, it is determined whether the engine start is complete based on the engine rotational speed, and, if the engine start is complete, the oil control valve 60 is set in the second mode MD2 (advance release mode) on the assumption that there is a release request to release engagement of the restricting pin 41 and the engaging hole 48. Then, after a predetermined period of time has elapsed, the completion of the initial release after the engine start is recorded in a flag F.

When the initial release is being carried out, step S110 and the following steps are executed. In step S110 and the following steps, a feedback control that changes the valve timing VT based on the target phase angle VTT and pre-control prior to the feedback control is executed.

In step S110, it is determined whether a phase variation request in the feedback control is an advance request to advance the valve timing VT with respect to the actual phase angle VTR and whether the actual phase angle VTR is at VTmin. That is, through the above process, it is determined whether it is necessary to disengage the restricting pin 41 from the engaging hole 48 (advance release request). Actually, unless there is a sensor that directly detects the movement of the restricting pin 41, it is impossible to determine whether the restricting pin 41 is engaged with the engaging hole 48. Therefore, in this control, when the actual phase angle VTR is the most retarded timing VTmin, it is assumed that it is necessary to disengage the restricting pin 41 from the engaging hole 48 (release request state). Accordingly, it is determined that there is an advance release request.

Unless the condition that the request to change the valve timing is an advance request and the actual phase angle. VTR is at VTmin is satisfied, the feedback control is executed in step S120 to change the valve timing VT to the target phase angle VTT. After the feedback control, the hold learning control is executed in step S130 to update the holding duty ratio DHA.

In contrast, if the request to change the valve timing is an advance request and the actual phase angle VTR is at VTmin in step S110, the duty ratio of the oil control valve 60 is set to fall within the advance release range BR3 (hereinafter, "release duty ratio DHF") in step S140. At this time, the oil control valve 60 is driven in the second mode MD2 (advance release mode).

The release duty ratio DHF is obtained by adding a previously obtained correction amount to the reference duty ratio DHK. The correction amount is obtained in such a manner that, when the correction amount is added to the reference duty ratio DHK, the resultant duty ratio falls within the advance release range BR3.

Subsequently, in step S150, it is determined whether the actual phase angle VTR is VTmin. For example, it is determined whether the actual phase angle VTR is more advanced than a determination angle VTJ that is set on an advance side with respect to VTmin. By so doing, it is determined whether the valve timing VT is locked, that is, whether the restricting pin 41 is disengaged from the engaging hole 48. If the determination is negative in step S150, the feedback control is executed. In contrast, if the determination is affirmative, the process ends, and the processes of step S110 to step S150 are executed again after a predetermined interval of time has elapsed. That is, when is it confirmed that the restricting pin 41 is disengaged from the engaging hole, the feedback control and the hold learning control are executed.

In this way, in the valve timing control, before the feedback control is executed, it is determined whether there is a possibility that the valve timing is locked. For example, when the valve timing VT is at VTmin, the feedback control is not executed until it is determined in step S140 and step S150 that the valve timing is not locked. If it is determined that the valve timing is not at VTmin, the feedback control is executed.

Figure 11:
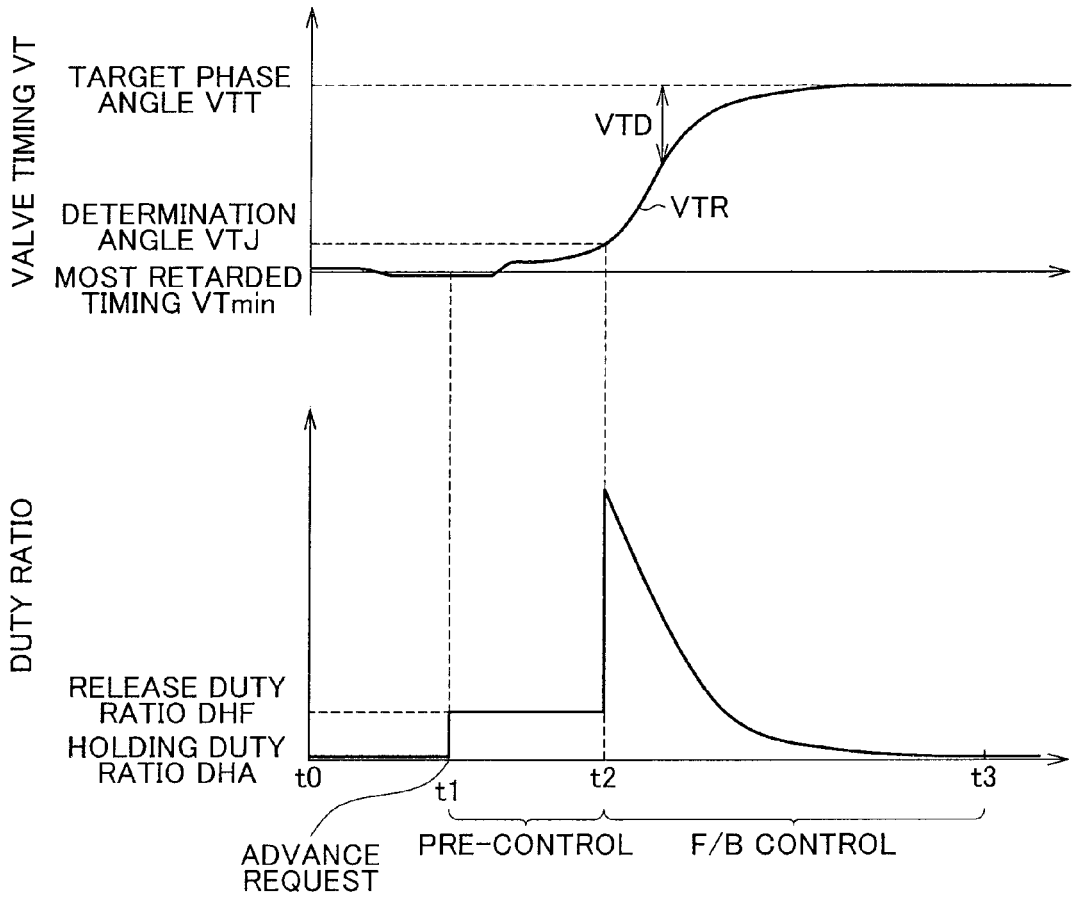
FIG. 11 is a timing chart that shows the variations in the duty ratio and changes in the valve timing in the variable valve timing apparatus according to the embodiment.

An example of a change in the valve timing VT and a variation in the duty ratio when the valve timing control is executed while the actual phase angle VTR is at VTmin will be described with reference to FIG. 11.

At time t0, the actual phase angle VTR is at VTmin, and the duty ratio is the holding duty ratio DHA. At this time, the target phase angle VTT is at VTmin, and the actual phase angle VTR is around VTmin. The differential phase VTD of the actual phase angle VTR with respect to the target phase angle VTT is below the deviation threshold value XA, so the duty ratio is maintained at the holding duty ratio DHA during the feedback control.

At time t1, the electronic control unit 91 issues an advance request based on the engine load and the operating condition, and the target phase angle VTT is set. Then, it is determined through the pre-control that the actual phase angle VTR is at VTmin and the advance request is issued. Accordingly, the duty ratio is set to the release duty ratio DHF.

At time t2, the actual phase angle VTR is more advanced than VTmin. Then, it is determined through the pre-control of the valve timing control that the actual phase angle VTR is more advanced than the determination angle VTJ. Accrodingly, the duty ratio is set based on the target phase angle VTT through the feedback control. After that, the duty ratio is periodically updated through the feedback control.

At time t3, when the actual phase angle VTR has converged with the target phase angle VTT and it is determined that the differential phase VTD of the actual phase angle VTR with respect to the target phase angle VTT is below the deviation threshold value XA, it is determined that the actual phase angle VTR has converged to the target phase angle VTT, and the duty ratio is maintained at the holding duty ratio DHA.

According to the present embodiment, the following advantageous effects may be obtained. First, if the engine has been started or if the actual phase angle VTR is at VTmin and there is an advance request to advance the valve timing VT are regarded as a release request state. Then, when the engine operating state is the above release request state, the controller 90 sets the duty ratio to fall within the advance release range BR3.

Accordingly, when the housing rotor 31 is disengaged from the vane rotor 35, the duty ratio of the oil control valve 60 is set lower than the duty ratio in the active band. Therefore, it is possible to reduce the frequency of a situation in which the housing rotor 31 remains engaged with the vane rotor 35 due to a high advance speed of the valve timing VT. That is, it is possible to smoothly unlock the valve timing VT.

In the present embodiment, the duty ratio at which the advance speed of the valve timing VT is the first advance speed B1 is set as a first advance duty ratio DHY1, and the duty ratio at which the advance speed of the valve timing VT is the second advance speed B2 that is higher than the first advance speed B1 is set as a second advance duty ratio DHY2. The range from the first advance duty ratio DHY1 to the second advance duty ratio DHY2 is set as the advance release range BR3.

With the above configuration, when the duty ratio of the oil control valve 60 falls within the advance release range BR3, the advance speed of the valve timing VT is lower than the second advance speed B2. In addition, when the duty ratio of the oil control valve 60 falls within the advance active band AR3, the advance speed of the valve timing VT is higher than the second advance speed B2.

(3) In the present embodiment, when the engine operating state is a release request state, the controller 90 sets the duty ratio of the oil control valve 60 to a duty ratio that falls within the advance release range BR3. After that, when it is detected that the valve timing VT, is more advanced than VTmin, the duty ratio of the oil control valve 60 is adjusted to a duty ratio that falls within the advance active band AR3.

In the above configuration, if the valve timing VT is more advanced than VTmin, that is, if disengagement of the housing rotor 31 from the vane rotor 35 is detected, the duty ratio is adjusted from a value that falls within the dead band AR2 to a value that falls within the advance active band AR3 based on an advance request. Thus, it is possible to prevent the advance speed of the valve timing VT from being increased before the housing rotor 31 is disengaged from the vane rotor 35.

In the present embodiment, when the engine operating state is a release request state, the controller 90 sets the duty ratio of the oil control valve 60 to a duty ratio that falls within the advance release range BR3 to thereby set the operation mode of the oil control valve 60 to the second mode MD2 (advance release mode).

With the above configuration, when the engine operating state is a release request state, oil is supplied to the advance chambers 38 and the advance release chamber 47 and oil is retained in the retard chambers 39, so the advance speed of the valve timing VT is lower than that when oil is not retained in the retard chambers 39. Thus, it is possible to smoothly unlock the valve timing VT.

(5) In the present embodiment, the advance release chamber 47 is supplied with oil via one of the advance chambers 38. With the above configuration, when the operation mode of the oil control valve 60 is set to the second mode MD2 (advance release mode), oil is supplied to the advance chambers 38 and to the advance release chamber 47 via one of the advance chambers 38, and oil is retained in the retard chambers 39. By so doing, the housing rotor 31 may be smoothly disengaged the vane rotor 35.

In the present embodiment, the controller 90 learns the holding duty ratio DHA. When the engine operating state is a release request state, the advance release range BR3 is set based on the reference duty ratio DHK that is learned after the engine is started.

The holding duty ratio DHA is set by learning the duty ratio at which the position of the vane rotor 35 does not change; however, because of the influence of a variation in the engine operating state, the learned value may deviate from the duty ratio at which the position of the vane rotor 35 does not change. After the engine is started, variations in various parameters are small and the internal combustion engine 1 is stable as compared with those during engine operation thereafter. Therefore, the frequency of error learning is lower in learning the holding duty ratio DHA after the engine is started than in learning the holding duty ratio DHA during engine operation. Thus, with the above configuration, it is possible to suppress a deviation between the set advance release range BR3 and the actual advance release range BR3.

Note that the invention is not restricted to the embodiment described above; the embodiment may be modified into the following alternative embodiments. In addition, the following alternative embodiments are not only applied to the above embodiment but a combination of different alternative embodiments may also be implemented.

Figure 10:
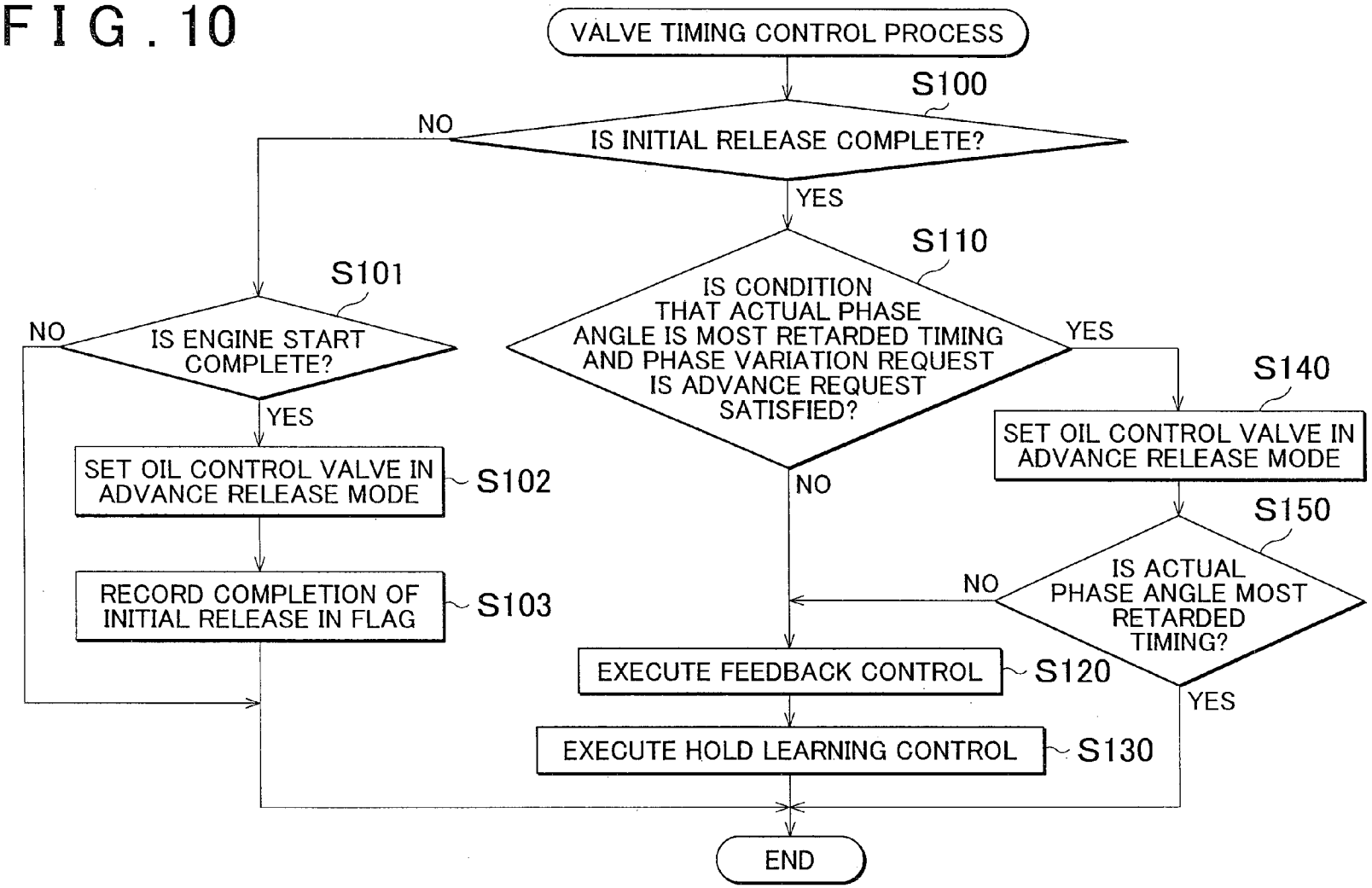
FIG. 10 is a flowchart that shows the process of "valve timing control" executed by an electronic control unit over the variable valve timing apparatus according to the embodiment.

In the above embodiment, as shown in FIG. 10, after the engine has been started, it is determined whether the restricting pin 41 is disengaged from the engaging hole 48; however, the disengagement of the restricting pin 41 from the engaging hole 48 after the engine is started (step S101 to step S103) and a determination as to the release (step S100) may be omitted. That is, in the variable valve timing mechanism 30 according to the present embodiment, the restricting pin 41 is disengaged from the engaging hole 48 when the hydraulic pressure in the advance release chamber 47 has increased after an engine start. Therefore, it is possible to omit the step of disengaging the restricting pin 41 from the engaging hole 48 after the engine is started.

In the above embodiment, as shown in FIG. 10, when a request to change the valve timing VT to the target phase angle VTT is detected, the duty ratio of the oil control valve 60 is set to a release duty ratio DHF that falls within the advance release range BR3. After that, it is determined whether the actual phase angle VTR is VTmin. However, the above determination (step S150) may be omitted.

Instead of the above determination, the subsequent step may be executed after a predetermined period of time has elapsed after the duty ratio of the oil control valve 60 is set to the release duty ratio DHF. That is, it is assumed that the actual phase angle VTR is advanced from VTmin after the predetermined period of time has elapsed, and then the subsequent feedback control is executed.

In the above embodiment, the release duty ratio DHF is calculated based on the reference duty ratio DHK so as to be a predetermined value that falls within the advance release range BR3. However, the release duty ratio DHF may also fall within a narrow range in the advance release range BR3. For example, the release duty ratio DHF may be set to a value around the duty ratio at an advance-side end of the advance release range BR3.

In the above embodiment, if the varying speed SP of the valve timing VT with respect to the duty ratio closely correlates with the position of the spool 62, the range of the duty ratio of the advance release range BR3 is set. Alternatively, the range of the duty ratio of the advance release range BR3 may be defined by the correlation of an advance rotation speed of the vane rotor 35 with respect to the housing rotor 31. For example, the duty ratio corresponding to a second advance rotation speed at which the rate of change in the advance rotation speed of the vane rotor 35 with respect to the housing rotor 31 increases is set to a second advance duty ratio DHW2, and the duty ratio corresponding to a first advance, rotation speed lower than the second advance rotation speed is set to a first advance duty ratio DHW1. The advance release range BR3 may be set to range from the first advance duty ratio DHW1 to the second advance duty ratio DHW2.

In addition, the advance release range BR3 may be defined solely by the correlation of the varying speed SP of the valve timing VT. For example, in the graph that shows a varying speed SP with respect to a duty ratio in FIG. 7, the duty ratio at which the rate of change in the varying speed SP increases is set as the second advance duty ratio DHZ2, and the duty ratio obtained by subtracting a predetermined value from the second advance duty ratio DHZ2 is set as the first advance duty ratio DHZ1. Then, the advance release range BR3 is set to range from the first advance duty ratio DHZ1 to the second advance duty ratio DHZ2.

In addition, each duty ratio range may be defined solely by the relative position of the spool 62 within the sleeve 61. For example, the spool 62 is in the fourth position PS4 with respect to the sleeve 61, the duty ratio corresponding to the position of an advance-side end is set as the second advance duty ratio DHU2, and the duty ratio corresponding to the position of a retard-side end is set as the first advance duty ratio DHU1. Then, the advance release range BR3 is set to range from the first advance duty ratio DHU1 to the second advance duty ratio DHU2.

In the above embodiment, the invention is applied to a variable valve timing mechanism 30 that includes a phase locking mechanism 40 for locking the valve timing VT at VTmin. However, the invention may be applied to any a mechanism that executes a hydraulic control having a mode in which draining of the oil from the retard chambers 39 is suppressed and oil is supplied to the advance release chamber 47 when the valve timing is advanced.

In the above embodiment, the invention is applied to a variable valve timing mechanism 30 that includes a phase locking mechanism 40 that locks the housing rotor 31 to the vane rotor 35 using one restricting pin 41. However, the invention may also be applied to a variable valve timing mechanism 30 that includes a phase locking mechanism 40 that locks the housing rotor 31 to the vane rotor 35 using two restricting pins 41.

In the above embodiment, the restricting pin 41 is provided in the vane rotor 35, and the engaging hole 48 is formed in the housing rotor 31. However, the restricting pin 41 may also be provided in the housing rotor 31 and the engaging hole 48 is formed in the vane rotor 35.

In the above embodiment, the restricting pin 41 is engaged with or released from the engaging hole 48 in the axial direction of the vane rotor 35. However, the restricting pin 41 and the engaging hole 48 may be formed so that the restricting pin 41 is engaged with or released from the engaging hole 48 in the radial direction of the vane rotor 35.

In the above embodiment, the invention is applied to a variable valve timing mechanism 30 that locks the valve timing VT at VTmin. However, the invention may also be applied to a variable valve timing mechanism 30 that locks the valve timing VT at the most advanced timing VTmax. Below, a specific example in which the invention is applied to a variable valve timing mechanism 30 that locks the valve timing VT at the most advanced timing VTmax will be described.

The variable valve timing mechanism 30 that locks the valve timing VT at the most advanced timing VTmax is provided for the exhaust camshaft 24. The phase locking mechanism 40 of the variable valve timing mechanism 30 locks the vane rotor 35 at the most advanced phase PC with respect to the housing when the valve timing VT is the most advanced timing VTmax. The correlation among the advance chambers 38, the advance release chamber 47 and the advance oil passage 55 and the correlation among the retard chambers 39, the retard release chamber 46 and the retard oil passage 56 are the same as those of the above embodiment. However, the correlation between the advance release chamber 47 and the retard release chamber 46 is the opposite of that in the above embodiment. That is, the retard release chamber 46 corresponds to the engaging hole 48, and the advance release chamber 47 corresponds to a hydraulic pressure chamber provided in one of the vanes 36.

When the request to change the valve timing is a retard request and the actual phase angle VTR is the most advanced timing VTmax, the duty ratio of the oil control valve 60 is set to a release duty ratio DHF that falls within the retard release range BR1. At this time, the oil control valve 60 is driven in the fourth mode MD4 (retard release mode). Thus, the valve timing VT is retarded at a speed lower than that when the oil control valve 60 inset in the fifth, mode MD5. In addition, the restricting pin 41 is displaced in the accommodating direction ZB at a speed higher than that when the oil control valve 60 is set in the third mode MD3. Thus, it is possible to smoothly releae the restricting pin 41 from the engaging hole 48.

In this case, the retard release range BR1 may be set in the same manner as in the above embodiment. However, the retard release range BR1 may also be set in the following manner. For example, the retard release range BR1 may be defined solely by the correlation of the retard speed of the vane rotor 35 with respect to the housing rotor 31. For example, the duty ratio corresponding to a second retard rotation speed, at which the rate of change in the retard rotation speed of the vane rotor 35 with respect to the housing rotor 31 increases with a reduction in the duty ratio, may be set as a fourth retard duty ratio DHW4, and the duty ratio corresponding to a first retard rotation speed, which is lower than the second retard rotation speed, may be set as a third retard duty ratio DHW3. Accordingly, the retard release range BR1 may be range from the fourth retard duty ratio DHW4 to the third retard duty ratio DHW3.

In addition, the retard release range BR1 may be defined based on only the correlation of the varying speed SP of the valve timing VT, or the retard release range BR1 may be defined as the correlation of the position of the spool 62 with respect to the sleeve 61.

The invention claimed is:

1. A variable valve timing apparatus for an internal combustion engine, comprising:

a hydraulic variable valve timing mechanism that changes a valve timing by varying a rotational phase of an output rotor with respect to an input rotor and also locks the valve timing to a specific timing by engaging the input rotor with the output rotor;

a hydraulic control mechanism that controls a mode in which hydraulic fluid is supplied to the hydraulic variable valve timing mechanism; and a controller that varies a duty ratio of the hydraulic control mechanism within a set range, wherein in the variable valve timing apparatus:

the set range includes a first range, a second range, and a third range, the first range includes a holding duty ratio at which a varying speed of the valve timing is zero, and a range in which the varying speed at which the valve timing is advanced, is below a first advance speed, wherein in the first range a third mode is established by the hydraulic control mechanism, wherein in the third mode the supply of hydraulic fluid to an advance chamber and a retard chamber of the hydraulic variable valve timing mechanism is interrupted, the second range is a range in which a varying speed of the valve timing is higher than that in the first range and engagement of the input rotor and the output rotor is released, wherein in the second range a second mode is established by the hydraulic control mechanism, wherein in the second mode hydraulic fluid is supplied to the advance chamber and the supply of hydraulic fluid to the retard chamber is interrupted, the third range is a range in which a varying speed of the valve timing is higher than that in the first range and in the second range, wherein in the third range a first mode is established by the hydraulic control mechanism, wherein in the first mode hydraulic fluid is supplied to the advance chamber and drained from the retard chamber, and when an engine operating state is a release request state, the controller sets the duty ratio of the hydraulic control mechanism to a duty ratio that falls within the second range, wherein the release request state is an operating state where the valve timing is the specific timing and the engine operating state is an advance request state, and when the engine operating state is the release request state, by mode switching the controller sets the duty ratio of the hydraulic control mechanism to a duty ratio that falls within an advance release range of the second range, if the valve timing is changed to be more advanced than the specific timing thereafter, by mode switching the controller adjusts the duty ratio of the hydraulic control mechanism to a duty ratio that falls within the third range.

2. The variable valve timing apparatus according to claim 1, wherein in the advance release range the valve timing is advanced at a higher speed than in the first range and the input rotor is disengaged from the output rotor.

3. The variable valve timing apparatus according to claim 1, wherein a duty ratio at which the advance speed of the valve timing is a first advance speed is set as a first advance duty ratio, a duty ratio at which the advance speed of the valve timing is a second advance speed, which is higher than the first advance speed, is set as a second advance duty ratio, and a range from the first advance duty ratio to the second advance duty ratio is set as the advance release range.

4. The variable valve timing apparatus according to claim 1, wherein the hydraulic variable valve timing mechanism includes an advance chamber used to advance the valve timing, a retard chamber used to retard the valve timing and an advance release chamber used to unlock the valve timing from the specific timing, the hydraulic control mechanism is configured to have the plurality of operation modes in which hydraulic fluid is supplied to the hydraulic variable valve timing mechanism and the plurality of operation modes includes an advance release mode, in which hydraulic fluid is supplied to the advance chamber and the advance release chamber and hydraulic fluid is retained in the retard chamber, and when the engine operating state is the release request state, the controller sets the duty ratio of the hydraulic control mechanism to a duty ratio that falls within the advance release range to thereby set the operation mode of the hydraulic control mechanism to the advance release mode.

5. The variable valve timing apparatus according to claim 4, wherein hydraulic fluid is supplied to the advance chamber when the rotational phase of the output rotor is advanced with respect to the input rotor, and hydraulic fluid is drained from the advance chamber when the rotational phase of the output rotor is retarded with respect to the input rotor, hydraulic fluid is supplied to the retard chamber when the rotational phase of the output rotor is retarded with respect to the input rotor, hydraulic fluid is drained from the retard chamber when the rotational phase of the output rotor is advanced with respect to the input rotor, and hydraulic fluid is retained in the retard chamber when the hydraulic control mechanism is set in the advance release mode, and the advance release chamber is supplied with hydraulic fluid via the advance chamber.

6. The variable valve timing apparatus according to claim 1, wherein the hydraulic variable valve timing mechanism changes the valve timing of an intake valve by varying the rotational phase of the output rotor with respect to the input rotor and maintains the valve timing at a most retarded timing as the specified timing by engaging the input rotor with the output rotor.

7. A variable valve timing apparatus for an internal combustion engine, comprising:

a hydraulic variable valve timing mechanism that changes a valve timing by varying a rotational phase of an output rotor with respect to an input rotor and also locks the valve timing to a specific timing by engaging the input rotor with the output rotor;

a hydraulic control mechanism that controls a mode in which hydraulic fluid is supplied to the hydraulic variable valve timing mechanism; and a controller that varies a duty ratio of the hydraulic control mechanism within a set range, wherein in the variable valve timing apparatus:

the set range includes a first range, a second range, and a third range, the first range includes a holding duty ratio at which a varying speed of the valve timing is zero, and a range in which the varying speed at which the valve timing is retarded, is below a first retard speed, wherein in the first range a third mode is established by the hydraulic control mechanism, wherein in the third mode the supply of hydraulic fluid to an advance chamber and a retard chamber of the hydraulic variable valve timing mechanism is interrupted, the second range is a range in which a varying speed of the valve timing is higher than that in the first range and engagement of the input rotor and the output rotor is released, wherein in the second range a fourth mode is established by the hydraulic control mechanism, wherein in the fourth mode the supply of hydraulic fluid to the advance chamber is interrupted and hydraulic fluid is supplied to the retard chamber, the third range is a range in which a varying speed of the valve timing is higher than that in the first range and in the second range, wherein in the third range a fifth mode is established by the hydraulic control mechanism, wherein in the fifth mode hydraulic fluid is drained from the advance chamber and hydraulic fluid is supplied to the retard chamber, and when an engine operating state is a release request state, the controller sets the duty ratio of the hydraulic control mechanism to a duty ratio that falls within the second range, wherein the release request state is an operating state where the valve timing is the specific timing and the engine operating state is a retard request state, and when the engine operating state is the release request state, by mode switching the controller sets the duty ratio of the hydraulic control mechanism to a duty ratio that falls within a retard release range of the second range, if the valve timing has been changed to be more retarded than the specific timing thereafter, by mode switching the controller sets the duty ratio of the hydraulic control mechanism to a duty ratio that falls within the third range.

8. The variable valve timing apparatus according to claim 7, wherein in the retard release range a retard speed that is a varying speed at which the valve timing is retarded is higher than a varying speed in the first range and engagement of the input rotor and the output rotor is released.

9. The variable valve timing apparatus according to claim 7, wherein a duty ratio at which the retard speed of the valve timing is a first retard speed is set as a first retard duty ratio, a duty ratio at which the retard speed of the valve timing is a second retard speed, which is higher than the first retard speed, is set as a second retard duty ratio, and a range from the second retard duty ratio to the first retard duty ratio is set as the retard release range.

10. The variable valve timing apparatus according to claim 7, wherein the hydraulic variable valve timing mechanism includes an advance chamber used to advance the valve timing, a retard chamber used to retard the valve timing and a retard release chamber used to unlock the valve timing from the specified timing, the hydraulic control mechanism is configured to have the plurality of operation modes in which hydraulic fluid is supplied to the hydraulic variable valve timing mechanism and the plurality of operation modes includes a retard release mode, in which hydraulic fluid is supplied to the retard chamber and the retard release chamber and hydraulic fluid is retained in the advance chamber, and if the engine operating state is the release request state, the controller sets the duty ratio of the hydraulic control mechanism to a duty ratio that falls within the retard release range to thereby set the operation mode of the hydraulic control mechanism to the retard release mode.

11. The variable valve timing apparatus according to claim 10, wherein hydraulic fluid is supplied to the advance chamber if the rotational phase of the output rotor is advanced with respect to the input rotor, hydraulic fluid is drained from the advance chamber if the rotational phase of the output rotor is retarded with respect to the input rotor, and hydraulic fluid in the advance chamber is retained if the hydraulic control mechanism is set in the retard release mode, hydraulic fluid is supplied to the retard chamber if the rotational phase of the output rotor is retarded with respect to the input rotor, and hydraulic fluid is drained from the retard chamber if the rotational phase of the output rotor is advanced with respect to the input rotor, and the retard release chamber is supplied with hydraulic fluid via the retard chamber.

12. The variable valve timing apparatus according to claim 7, wherein the hydraulic variable valve timing mechanism changes the valve timing of an exhaust valve by varying the rotational phase of the output rotor with respect to the input rotor and holds the valve timing, at a most advanced timing by engaging the input rotor with the output rotor.

13. The variable valve timing apparatus according to claim 1 wherein the controller learns the holding duty ratio after the engine is started, and, if the engine operating state is the release request state, the controller sets the release range based on the learned holding duty ratio.

* * * * *